US006059042A

United States Patent [19]

Huber et al.

[11] Patent Number: 6,059,042

[45] Date of Patent: May 9, 2000

[54] COMPLETIONS INSERTION AND RETRIEVAL UNDER PRESSURE (CIRP) APPARATUS INCLUDING THE SNAPLOCK CONNECTOR

[75] Inventors: Klaus B. Huber, Sugar Land; A. Glen Edwards, Hockley; Edward G. Smith, Jr., San Leon; Laurent E. Muller, Stafford, all of Tex.

[73] Assignee: Schlumberger Technology Corporation, Sugar Land, Tex.

[21] Appl. No.: 09/095,269

[22] Filed: Jun. 10, 1998

Related U.S. Application Data

[62] Division of application No. 08/638,001, Apr. 25, 1996.
[60] Provisional application No. 60/010,500, Jan. 24, 1996.

[51] Int. Cl.[7] ..... E21B 43/117; E21B 23/00; E21B 19/16

[52] U.S. Cl. ..... 166/377; 166/67; 166/70; 166/77.51; 166/85.1; 166/378

[58] Field of Search ..... 166/377, 378, 166/379, 380, 67, 70, 77.51, 85.1, 117.7

[56] References Cited

U.S. PATENT DOCUMENTS

| | | | |
|---|---|---|---|
| 2,758,654 | 8/1956 | Simmons | 166/380 |
| 3,434,543 | 3/1969 | Webb | 166/117.7 |
| 4,375,834 | 3/1983 | Trott | 166/297 |
| 4,598,771 | 7/1986 | Vann | 166/297 |
| 5,025,861 | 6/1991 | Huber et al. | 166/297 |
| 5,044,437 | 9/1991 | Wittrisch | 166/297 |
| 5,123,356 | 6/1992 | Brooks et al. | 102/275.12 |
| 5,509,481 | 4/1996 | Huber et al. | 166/297 |
| 5,529,127 | 6/1996 | Burleson et al. | 166/55.1 |

OTHER PUBLICATIONS

Article entitled "TCP Perforating on Coiled Tubing Utilizing a Deployment System" dated Mar. 13–16, 1995.
"Perforating and Testing Review" dated May 1995.
"Coiled Tubing Deployment System adapted for Single Trip Perforating" by Campbell and Davidson dated Jun. 28–30, 1994.

(List continued on next page.)

*Primary Examiner*—Hoang C. Dang
*Attorney, Agent, or Firm*—Gordon G. Waggett; John J. Ryberg; John Bouchard

[57] ABSTRACT

A completions insertion and retrieval under pressure (CIRP) apparatus utilizes a snaplock connector to assemble uphole a tool string of any desired length prior to lowering the tool string into a wellbore for performing wellbore operations in the wellbore. The tool string could comprise a perforating gun string including a plurality of perforating guns interleaved with a corresponding plurality of snaplock connectors. The CIRP apparatus includes a winch housing connected to a lubricator, the lubricator being connected to a valve, the valve being connected to a connection apparatus, such as a deployment BOP or a snaplock operator, the connection apparatus being connected to a work string which extends into the wellbore. When the valve is opened and the lubricator is pressurized, a second wellbore tool, which includes a third section of a snaplock connector, is disposed in the lubricator and a first wellbore tool, which includes a first and second section of a snaplock connector, is being held by the connection apparatus. The second wellbore tool is lowered by the winch through the lubricator into contact with the first wellbore tool, and the third section is connected to the second section of the snaplock connector. The connection apparatus releases its hold on the first wellbore apparatus, the winch lowers the second wellbore apparatus into the connection apparatus, and the connection apparatus holds the second wellbore apparatus until a third wellbore apparatus is connected to the second wellbore apparatus thereby creating a tool string. As a result, the tool string of any desired length can be build uphole before lowering the the tool string downhole for performing wellbore operations during one trip into the wellbore.

18 Claims, 13 Drawing Sheets

OTHER PUBLICATIONS

"Markham Well 49/5a–B2—2–7/8" TCP Guns on Coiled Tubing with the Depoyment System–Report, Undated.
"Coiled Tubing 1995 Update: Production applications" by Sas–Jaworsky II, et al., World Oil, vol. 216, No. 6, Jun. 1, 1995, pp. 97–105.
"Safe Deployment of Specialized Coiled–Tubing in Live Wells" by H.V. Thomeer, et al. SPE Proceedings, No. SPE 24621, Oct. 4, 1992, 799–808.
"Coiled Tubing Deployed TCP", undated.
"4.06 Safeconn Development System 10,000 psi Working Pressure", Texas Oil Tools, Mar. 1994, 25 pages.
"Toolstring Deployment System Trials" Nowsco Well Services, Jul. 1994, 21 pages.
"Tool Deployment System Incorporating Connect Perforating System", Guiberson AVA and Dresser, Jun. 1994, 17 pages.
Drawing, 1 pg.—3.06" O.D. × 2.88 I.D. Deployment Connector Assembly, Texas Oil Tools Inc., Jun. 22, 1994.

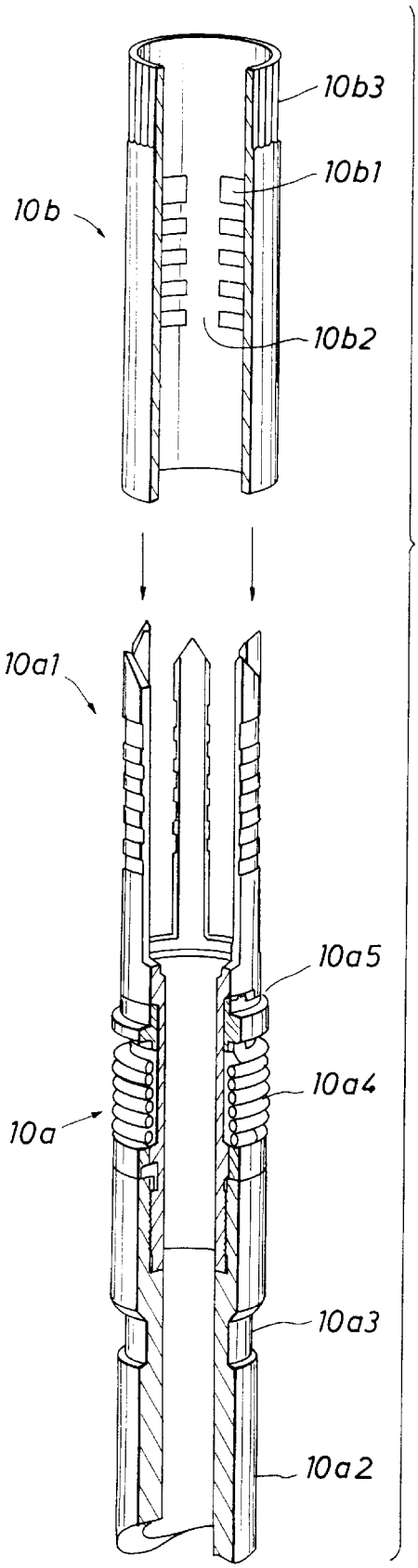
FIG. 2a
FIG. 2b
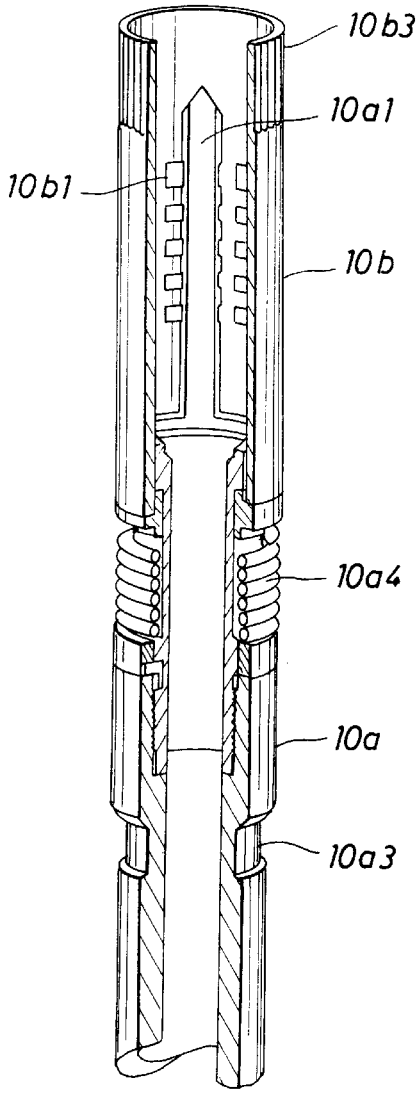

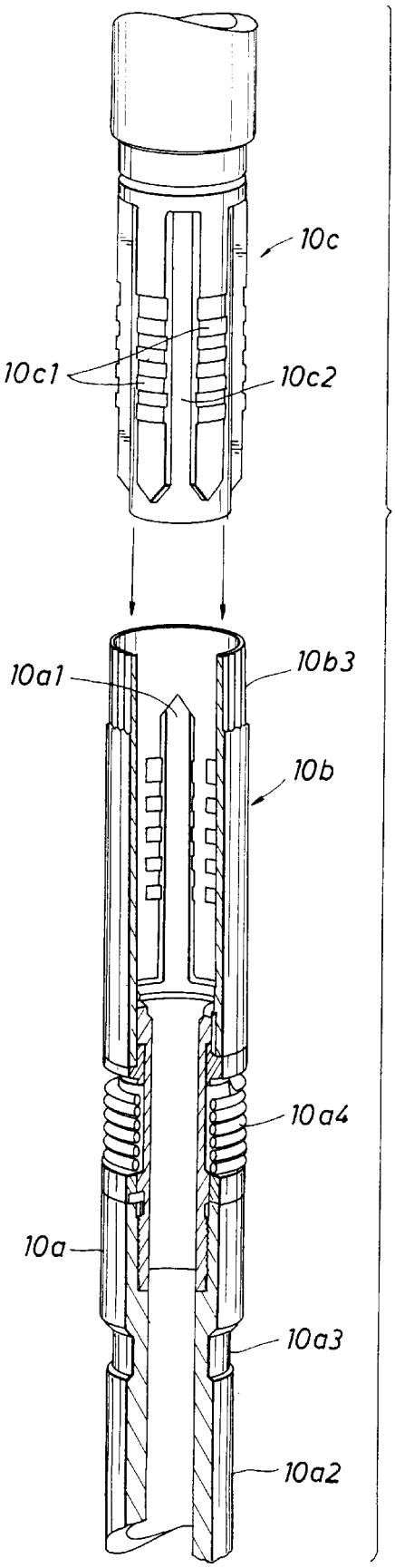
FIG. 3a
FIG. 3b
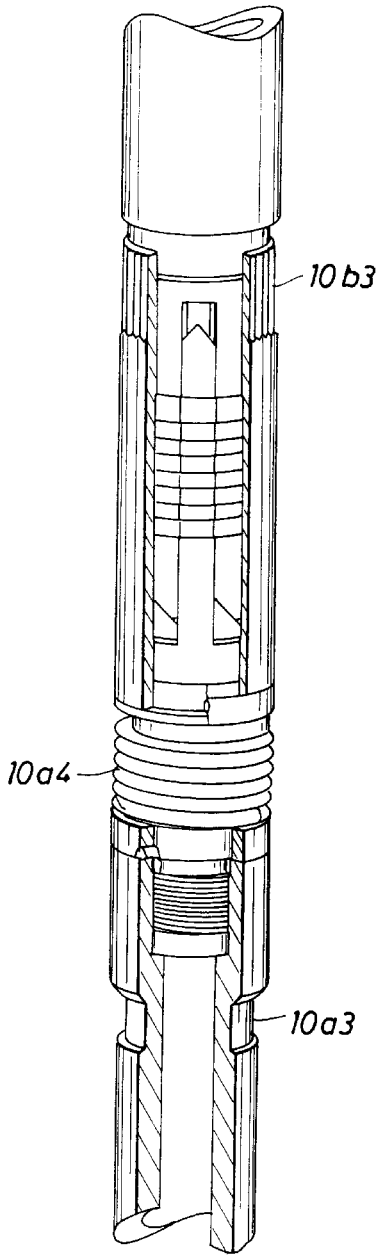

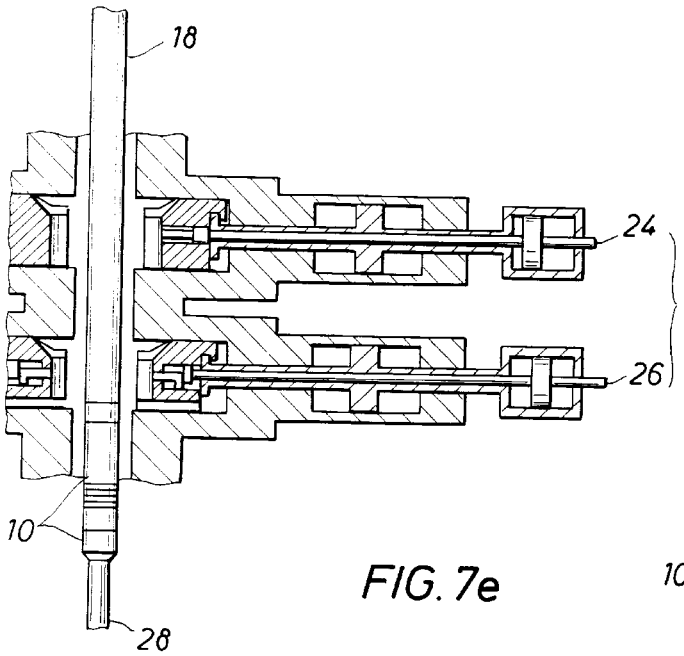
FIG. 7e
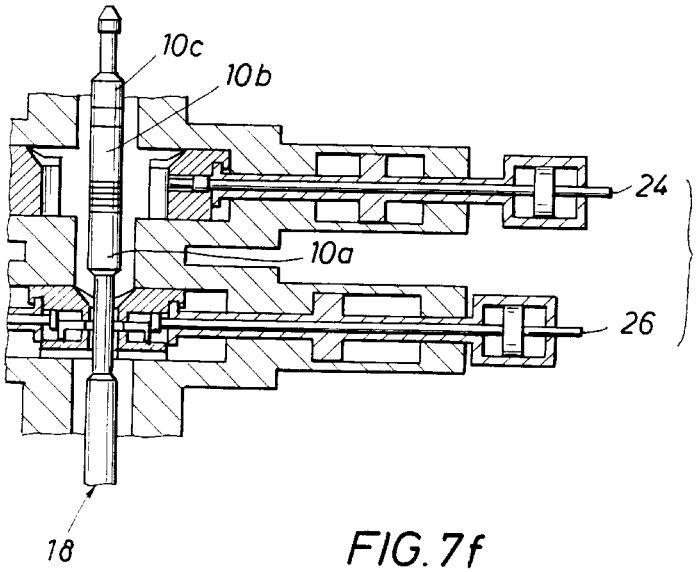
FIG. 7f
FIG. 8
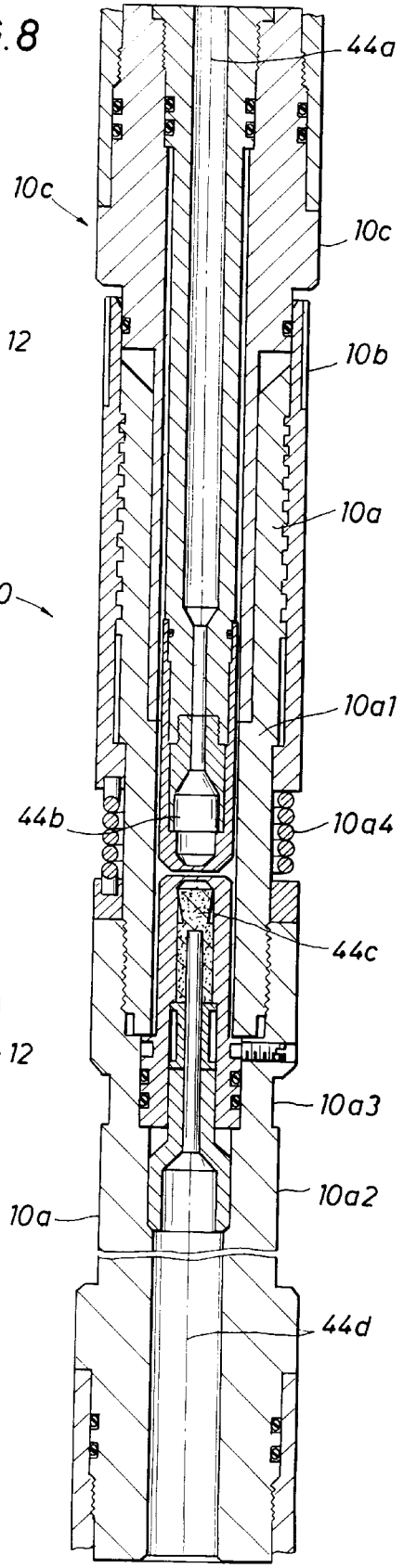

FIG. 20b
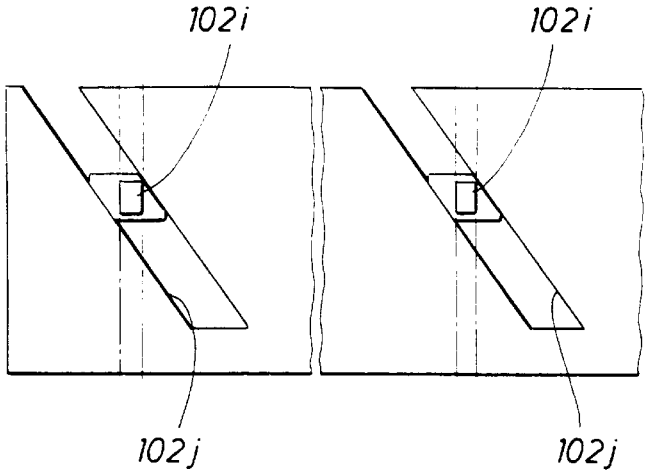
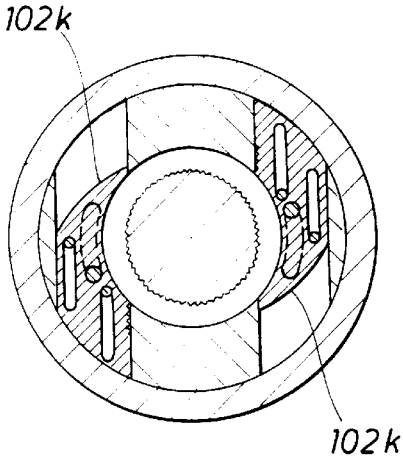
FIG. 20d
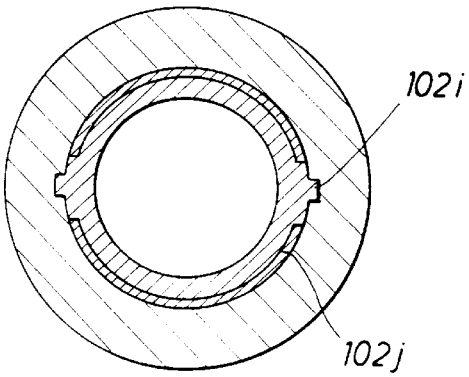
FIG. 20c

FIG. 20f
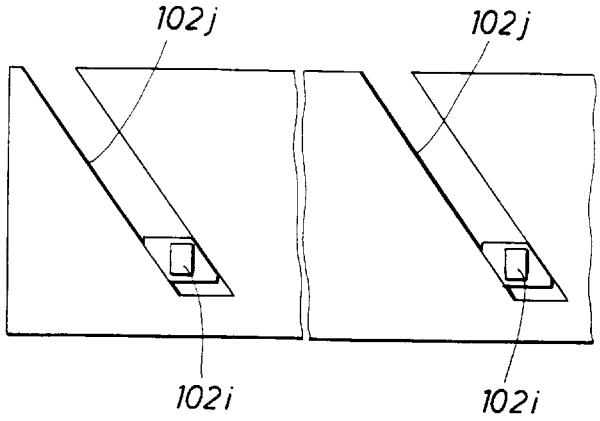
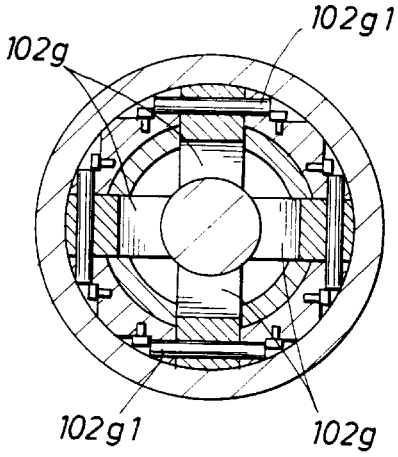
FIG. 20g
FIG. 20h
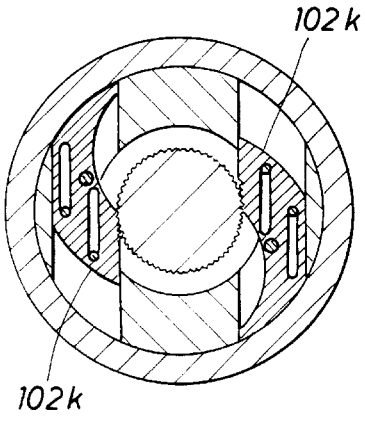

COMPLETIONS INSERTION AND RETRIEVAL UNDER PRESSURE (CIRP) APPARATUS INCLUDING THE SNAPLOCK CONNECTOR

CROSS REFERENCE TO RELATED APPLICATIONS

This application is a divisional application of U.S. Ser. No. 08/638,001, filed Apr. 25, 1996, which is based on a previously filed provisional application which is identified by application Ser. No. 60/010,500 filed Jan. 24, 1996.

BACKGROUND OF THE INVENTION

The subject matter of the present invention relates to a novel apparatus and method for assembling uphole a plurality of wellbore apparatus of any desired length prior to disposing the plurality of wellbore apparatus downhole in a wellbore. More particularly, the subject matter of the present invention relates to a method and apparatus for perforating long length intervals of a wellbore during a single run into the wellbore by assembling uphole a tool string of any desired length prior to lowering the tool string into a pressurized wellbore, the tool string including a plurality of perforating apparatus interleaved with a corresponding plurality of snaplock connectors.

Typically, when perforating long length intervals of oil and gas wells that have sufficient reservoir pressure to create a surface pressure, the owner of the wellbore had three options: (1) kill the well, pull the perforating guns out of the wellbore, and then run completion equipment back into the wellbore, (2) drill a rathole below the formation to be perforated, the length of the rathole being at least as long as the length of the formation to be perforated, so that the perforating guns can be dropped off after perforating, the perforating guns falling to the bottom of the rathole, and (3) run small perforating guns through the completion equipment. None of the above options provide optimal solutions to perforating such a wellbore. Another limiting factor relates to the length of the pressure equipment (lubricator) that can physically fit within a structure, such as a drilling or workover rig. In that case, if the intent is to perforate a long length interval of the formation underbalanced, it was necessary to shoot a short length interval of the formation underbalanced, the short length being dictated by the limited length of the lubricator, and then to shoot a plurality of additional short length intervals of the formation during a corresponding plurality of additional runs of the short perforating guns into the wellbore. This results in a less than optimum perforating technique and well performance.

The steps of killing the well, pulling the perforating guns out of the well, and rerunning the completion equipment back into the wellbore can result in damage to the formation to such an extent that the well may never produce as well as it did immediately after perforating. Furthermore, drilling a rathole that is at least as long in length as the perforated interval is very expensive, often resulting in costs of as much as $500,000. Running small perforating guns through the completion equipment results in shallow, small diameter perforation holes that may limit production from the well or the completion equipment.

SUMMARY OF THE INVENTION

Accordingly, it is a primary object of the present invention to provide a novel method and apparatus for assembling uphole a plurality of wellbore apparatus of any desired length prior to lowering the plurality of wellbore apparatus downhole and performing one or more wellbore operations.

It is a further object of the present invention to provide a novel method and apparatus for assembling uphole a plurality of wellbore apparatus of any desired length prior to lowering the plurality of wellbore apparatus downhole and performing one or more wellbore operations, the novel method including holding a first wellbore apparatus in a holding apparatus, lowering a second wellbore apparatus into the wellbore and connecting the second wellbore apparatus to the first wellbore apparatus where the lowering step could include operating a winch to lower the second wellbore apparatus into the wellbore, releasing the first wellbore apparatus from the holding apparatus, holding the second wellbore apparatus in the holding apparatus, lowering a third wellbore apparatus into the wellbore by operating the winch and connecting the third wellbore apparatus to the second wellbore apparatus, releasing the second wellbore apparatus from the holding apparatus, and lowering the first, second, and third wellbore apparatus downhole using the winch for performing the one or more wellbore operations.

It is a further object of the present invention to provide a novel method and apparatus for perforating long length intervals of a wellbore during a single run into the wellbore.

It is a further object of the present invention to provide a novel method and apparatus for perforating long length intervals of a wellbore during a single run into the wellbore, the novel apparatus for perforating long length intervals including an assembly apparatus adapted for assembling uphole and interconnecting together a plurality of perforating guns of any desired length where the assembly apparatus includes a lowering apparatus lowering the plurality of perforating guns downhole, the perforating guns perforating the long length interval of the wellbore.

It is a further object of the present invention to provide a novel method and apparatus for perforating long length intervals of a wellbore during a single run into the wellbore, the novel apparatus for perforating long length intervals including an assembly apparatus adapted for assembling uphole and interconnecting together a plurality of perforating guns of any desired length where the assembly apparatus includes a lowering apparatus lowering the plurality of perforating guns downhole, the perforating guns perforating the long length interval of the wellbore, the assembly apparatus including: a master valve disposed atop a work string in the wellbore; a lubricator housing disposed atop the master valve adapted to be pressurized; and the lowering apparatus disposed atop the lubricator housing, the lowering apparatus including a winch housing integrally connected to the lubricator housing adapted to be pressurized when the lubricator housing is pressurized and a winch disposed within the winch housing, the winch including a center piece and a cable coiled around the center piece which is adapted to be lowered into the lubricator housing when the center piece is rotated, there being no need to inject a cable into the top of the lubricator housing when the winch housing including the winch and coiled cable is disposed atop the lubricator housing.

It is a further object of the present invention to provide a novel method and apparatus for perforating long length intervals of a wellbore during a single run into the wellbore, the novel apparatus for perforating long length intervals including an assembly apparatus adapted for assembling uphole and interconnecting together a plurality of perforating guns of any desired length where the assembly apparatus includes a lowering apparatus lowering the plurality of perforating guns downhole, the perforating guns perforating the long length interval of the wellbore, the assembly apparatus including: a master valve disposed atop a work string in the wellbore; a lubricator housing disposed atop the master valve adapted to be pressurized; the lowering apparatus disposed atop the lubricator housing; and a connector adapted to interconnect a first perforating gun to a second perforating gun, the lowering apparatus including a winch housing integrally connected to the lubricator housing adapted to be pressurized when the lubricator housing is pressurized and a winch disposed within the winch housing, the winch including a center piece and a cable coiled around the center piece which is adapted to be lowered into the lubricator housing when the center piece is rotated, there being no need to inject a cable into the top of the lubricator housing when the winch housing including the winch and coiled cable is disposed atop the lubricator housing, the connector including a first connector adapted to be connected to the first perforating gun, a second connector adapted to be connected to the second perforating gun, and a connection means adapted to be connected to the first and second connectors for connecting the first connector to the second connector and disconnecting the first connector from the second connector, the first connector and the second connector connecting the first perforating gun to the second perforating gun when the connection means connects the first connector to the second connector, the first connector and the second connector disconnecting the first perforating gun from the second perforating gun when the connection means disconnects the first connector from the second connector, the connection means including either a deployment Blow Out Preventor (hereinafter called, a "deployment BOPÓ) or a snaplock operator adapted for twisting a first part of said first connector relative to a second part of said first connector, the connection means disconnecting the first connector from the second connector when the first part of said first connector is twisted relative to the second part of said first connector, the snaplock operator twisting the first part of the first connector relative to the second part of the first connector by receiving an increased hydraulic presssure from one hydraulic line and anchoring in place the second part of the first connector and receiving an increased hydraulic pressure from another hydraulic line and twisting the first part of the first connector when the second part of the first connector is anchored in place, the twisting of the first part taking place when a ring slides within a slanted slot in a housing in response to the increase in the hydraulic pressure in said another hydraulic line and a rack moves inwardly into a firm contact position against the first part of the first connector in response to the sliding of the ring in the slanted slot in the housing.

It is a further object of the present invention to provide a novel method and apparatus for perforating long length intervals of a wellbore during a single run into the wellbore, the novel apparatus for perforating long length intervals including an assembly apparatus adapted for assembling uphole and interconnecting together a plurality of perforating guns of any desired length prior to lowering the plurality of perforating guns downhole and perforating the long length interval of the wellbore, the novel method for perforating long length intervals including holding a first perforating apparatus in a holding apparatus, lowering a second perforating apparatus in the wellbore on a cable and connecting the second perforating apparatus to the first wellbore apparatus where the lowering step includes the step of rotating a center piece of a winch and unrolling the cable from the center piece of the winch, releasing the first perforating apparatus from the holding apparatus, holding the second perforating apparatus in the holding apparatus, disconnecting the cable from the second perforating apparatus and retrieving the disconnected cable uphole, connecting the cable uphole to a firing head, lowering the firing head on the cable into the wellbore, connecting the firing head apparatus to the second perforating apparatus, releasing the second perforating apparatus from the holding apparatus, and lowering the first and second perforating apparatus and the firing head apparatus downhole, and perforating the long length interval of the wellbore.

It is a further object of the present invention to provide a snaplock operator connection apparatus adapted for receiving a snaplock connector, which consists of a first connector and a second connector adapted to connect to the first connector, and for connecting and disconnecting the first connector associated with a first perforating gun from the second connector associated with a second perforating gun, the snaplock operator connection apparatus including a piston, a slip, and a means responsive to a first hydraulic pressure for moving the piston in response to the first hydraulic pressure and for swivelling the slip in response to the movement of the piston, the slip anchoring against a first part of the second connector when the slip swivels to a predetermined position, a further piston, a ring disposed at an end of the further piston, a slot adapted to receive the ring and to allow the ring to slide in the slot, a rack connected to the ring, and a further means responsive to a further hydraulic pressure for moving the further piston, the ring sliding in the slot when the further piston moves, the rack anchoring against a second part of the second connector and twisting the second part of the second connector relative to the first part of the second connector when the ring slides in the slot in response to the movement of the further piston, the first connector of the first perforating gun being disconnected from the second connector of the second perforating gun when the second part of the second connector is twisted by the rack relative to the first part of the second connector.

It is a further object of the present invention to provide a snaplock connector adapted to interconnect a first wellbore apparatus to a second wellbore apparatus including a first section, a second section, the first section adapted to be inserted into the second section, the second section adapted to be twisted relative to the first section, and a third section adapted to be inserted into the second section when the second section is twisted relative to the first section, the third section being locked to the second section when the twist to the second section relative to the first section is released, the third section including a charge and a first detonating cord interconnected between the charge and the first wellbore apparatus, the first and second sections including a booster and a second detonating cord interconnected between the booster and the second wellbore apparatus.

In accordance with these and other objects of the present invention, a completions insertion and retrieval under pressure (CIRP) apparatus utilizes a snaplock connector to assemble uphole a tool string of any desired length prior to lowering the tool string into a wellbore for performing wellbore operations in the wellbore. The tool string could comprise a perforating gun string including a plurality of perforating guns interleaved with a corresponding plurality of snaplock connectors. The CIRP apparatus includes a winch housing connected to a lubricator, the lubricator being connected to a valve, the valve being connected to a connection apparatus, such as a deployment BOP or a snaplock operator, the connection apparatus being connected to a work string which extends into the wellbore. When the valve is opened and the lubricator is pressurized, a second wellbore tool, which includes a third section of a snaplock connector, is disposed in the lubricator and a first wellbore tool, which includes a first and second section of a snaplock connector, is being held by the connection apparatus. The second wellbore tool is lowered by the winch through the lubricator into contact with the first wellbore tool, and the third section is connected to the second section of the snaplock connector. The connection apparatus releases its hold on the first wellbore apparatus, the winch lowers the second wellbore apparatus into the connection apparatus, and the connection apparatus holds the second wellbore apparatus until a third wellbore apparatus is connected to the second wellbore apparatus thereby creating a tool string of any desired length. As a result, the tool string of any desired length can be build uphole before lowering the the tool string downhole for performing wellbore operations during one trip into the wellbore.

More particularly, the CIRP method and apparatus, for assembling uphole a plurality of wellbore apparatus and for performing one or more wellbore operations downhole, includes a novel assembly and perforating method and apparatus for assembling uphole of a plurality of perforating guns of any desired gun length prior to lowering the plurality of perforating guns downhole for perforating a long length interval of a formation penetrated by the wellbore in a single run into the wellbore.

The novel assembly and perforating apparatus includes a work string, a deployment BOP or a snaplock operator disposed atop the work string, a master valve disposed atop the deployment BOP or snaplock operator, a lubricator housing adapted to be pressurized disposed atop the master valve, and a winch housing integrally connected to the lubricator housing disposed atop the lubricator housing, the winch housing including a winch having a cable rolled around a rotatable center piece. A first perforating gun is assumed to be held firmly in place by the deployment BOP/snaplock operator.

The novel assembly and perforating method includes the steps of holding the first perforating gun having a lower half of a snaplock connector in the deployment Blow Out Preventor (BOP) or in the snaplock operator when the master valve is closed, pressurizing the lubricator housing and opening the master valve, lowering a second perforating gun interconnected between a deployment stinger and an upper half of a snaplock connector down the lubricator housing by rotating the center piece of the winch and unrolling the cable from the center piece, connecting the lower half and the upper half of the snaplock connectors together thereby connecting the second perforating gun to the first perforating gun, releasing the first perforating gun from the deployment BOP or from the snaplock operator, lowering the second perforating gun by rotating the center piece of the winch and lowering the first perforating gun into the work string until the second perforating gun is disposed within the deployment BOP or in the snaplock operator, holding the second perforating gun in the deployment BOP or the snaplock operator, operating the deployment BOP/snaplock operator thereby disconnecting the deployment stinger from the second perforating gun, raising the deployment stinger uphole into the lubricator housing, closing the master valve and bleeding off the pressure inside the lubricator housing, removing the deployment stinger from the lubricator housing and replacing it with a firing head and a second deployment stinger suspending from the winch cable inside the lubricator housing, pressurizing the lubricator housing, opening the master valve, lowering the firing head and second deployment sting suspending from cable down through the lubricator housing and through the valve, connecting the firing head and the second deployment stinger to the second perforating gun, releasing the second perforating gun from the deployment BOP or snaplock operator, and lowering the tool string consisting of the first perforating gun, the second perforating gun, the firing head, and the second deployment stinger downhole until the tool string is disposed adjacent a long length interval of a formation to be perforated, and perforating the formation.

In the preferred embodiment, the tool string comprises a plurality of perforating guns, or other wellbore apparatus like packers or setting tools, interleaved with a plurality of snaplock connectors. As a result, any desired length of a tool string, comprised of a plurality of wellbore apparatus (such as perforating guns) interleaved with a corresponding plurality of snaplock connectors, may be lowered downhole for the purpose of performing one or more wellbore operations downhole.

The winch housing includes a winch and associated center piece with a cable rolled around the center piece. This winch apparatus eliminates the need to inject a cable into a stuffing box disposed atop the lubricator housing. In the past, it was difficult to retain a seal between the cable and the hole in the stuffing box when the cable was injected into the stuffing box. The aforementioned winch housing eliminates this former problem.

In the above description, a deployment stinger third section of a snaplock connector is connected to a second second section of the snaplock connector, and the second section is connected to a first section of the snaplock connector. The first section of the snaplock connector is further connected to a perforating gun which held within a deployment BOP or snaplock operator. The step of connecting (or disconnecting) the third section of the snaplock connector to the second section of the snaplock connector is accomplished by either the deployment BOP or a novel snaplock operator.

The novel snaplock operator includes a housing having a first port adapted to receive a first hydraulic pressure and a slip adapted to rotate when the first hydraulic pressure is received from the first port. The housing also includes a second port adapted to receive a second hydraulic pressure, a ring adapted to slide within a slanted slot in response to the second hydraulic pressure from the second port, and a rack adapted to move inwardly in response to the ring sliding in the slanted slot in the housing. A snaplock connector disposed inside the novel snaplock operator would have its first section held firmly by the rotated slip, and its second section twisted/rotated with respect to its first section when the rack moves inwardly into contact with the second section as described above. The twisting of the second section of the snaplock connector relative to its first section would disconnect the third deployment stinger section of the snaplock connector from the second section of the snaplock connector, whereas a release of the twist against the second section would allow the second section of the snaplock connector to rotate back to its original position relative to its first section thereby connecting and locking the third section of the snaplock connector to the second section of the snaplock connector.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein:

FIGS. 2*a* and 2*b* illustrate a lower outer mechanical part of a snaplock connector;

FIGS. 3*a* and 3*b* illustrate an outer mechanical part of the snaplock connector;

FIGS. 7*a* through 7*f* illustrate the assembly of a gun string using the CIRP apparatus;

FIG. 8 illustrates a cross sectional view of the snaplock connector;

FIGS. 20*a* through 20*h* illustrate in greater detail the snaplock operator of FIG. 19, wherein:

FIG. 20*a* is a longitudinal cross sectional view of the snaplock operator in a first position, FIG. 20*b* illustrates the ring sliding in the slot on the internal periphery of the outer housing, FIGS. 20*c* and 20*d* are transverse cross sectional views of the snaplock operator, as taken along section lines 20*c*—20*c* and 20*d*—20*d*, respectively, of FIG. 20*a*, FIG. 20*e* is a longitudinal cross sectional view of the snaplock operator in a second position, FIG. 20*f* illustrates the ring sliding in the slot on the internal periphery of the outer housing, FIGS. 20*g* and 20*h* are transverse cross sectional views of the snaplock operator, as taken along section lines 20*g*—20*g* and 20*h*—20*h*, respectively, of FIG. 20*e*.

DETAILED DESCRIPTION OF THE PREFERRED EMBODIMENT

A major need in well completion operations relates to the ability to introduce or retrieve long perforating gun strings into or out of a wellbore under pressure. Practical lubricator length versus desired gun length, always a problem during pressure jobs, has been further complicated by the increasingly longer gun strings currently being used in highly deviated or horizontal wells.

Presently, there are only three choices regarding retrieval of a gun string with pressure at the wellhead: (1) limit the perforating gun length to the length of the riser that can be used; for intervals requiring more than one gun run, only the first run can be shot underbalanced; (2) kill the well; inherent in this procedure is the risk of damaging the formation and compromising well productivity; and (3) provide sufficient rathole to permit dropping the perforating guns after shooting the guns, which results in a problem of added cost during drilling. One solution would appear to include a safe and effective downhole lubricator.

Unfortunately, the development of that device is still incomplete. Issues, such as remote operation of downhole valves and rams, tool insertion, removal techniques, and increasing gun length must be considered and resolved.

In the meantime, a novel insertion and retrieval method and apparatus has been developed for introducing a perforating gun string into a wellbore in sections or modules, and for retrieving the gun string from the wellbore in sections or modules. Using the aforementioned novel insertion and retrieval method and apparatus, pressure operations are feasible with any length of perforating gun string.

The aforementioned novel insertion and retrieval apparatus will hereinafter be called the "Completion Insertion and Retrieval under Pressure (CIRP)" System, also known hereinafter as the "CIRP System".

The novel CIRP System includes three key elements: (1) snaplock connectors 10, (2) a sealed ballistic transfer embodied within each snaplock connector 10, and (3) a deployment BOP 12. Each snaplock connector 10 is comprised of three sections, a first section, a second section adapted to be connected to the first section, and a third section adapted to be connected to the second section. The third section, called a deployment stinger, is adapted to be connected to the second section when the second section is connected to the first section and a twisting force is applied to the second section relative to the first section. The third deployment stinger section includes the sealed ballistic transfer (see FIG. 6). The deployment BOP 12 is used to provide the necessary twisting force to the second section relative to the first section; when the twisting force is applied, the third deployment stinger section of the snaplock connector may be connected to the second section of the snaplock connector 10 and the third deployment stinger section may be disconnected from the second section of the snaplock connector 10.

Figure 1:
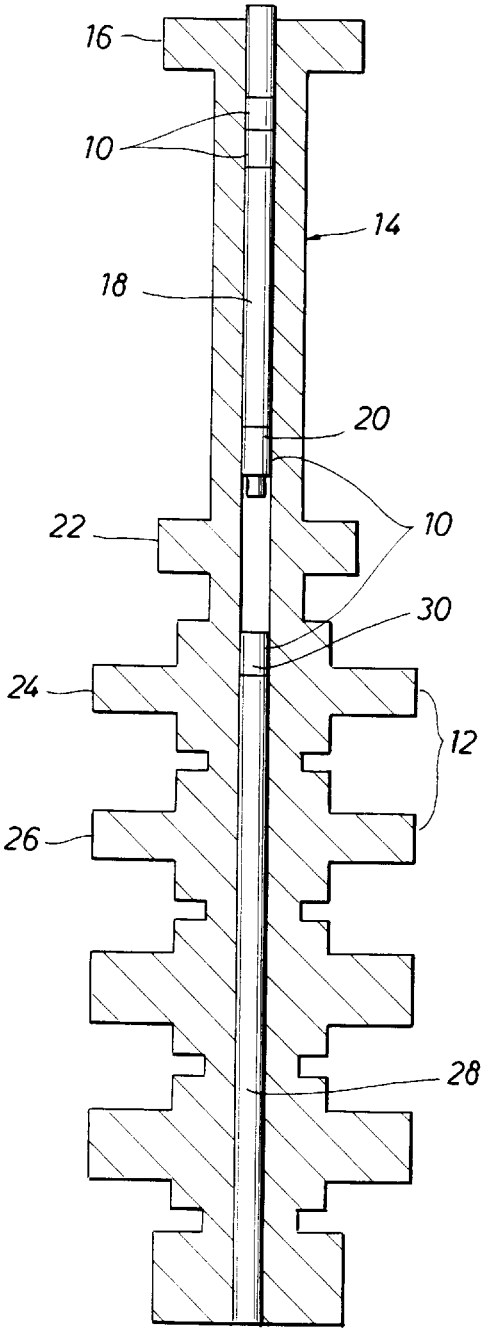
FIG. 1 illustrates a conceptual view of a retrieval system.

Referring to FIG. 1, the CIRP System is illustrated. In FIG. 1, the CIRP system includes an outer housing, the outer housing including: a pickup/laydown assembly 16, a lubricator 14, a master valve 22, and a deployment BOP 12. The deployment BOP 12 includes an upper deployment BOP 24 and a lower deployment BOP 26. The CIRP System also uses the "snaplock connector" 10 to be discussed below. The pickup/laydown assembly 16 is shown as element numeral 52 in FIGS. 9, 10, and 11 discussed below, the pickup and laydown assembly 16 being interconnected between a wireline and the upper half of the snaplock connector 10 (the upper half being the deployment stinger section 10*c*, discussed below). Assume that a first tool string comprising a gun string 28 and associated lower snaplock 30 are lowered into the lubricator 14 and subsequently firmly held within the deployment BOP 12. When the pickup/laydown assembly 16 and associated upper snaplock is removed from the lubricator 14, a second tool string may be lowered into the lubricator 14, and that second tool string comprises: an upper snaplock 20, a gun section 18 connected to the upper snaplock 20, and a snaplock connector 10 (consisting of a lower snaplock and an upper snaplock) connected to the gun section 18. When the pickup/laydown assembly 16 is in the lubricator 14 and the lubricator is made up on the master valve, the master valve 22 is opened, and the upper snaplock 20 of the second tool string may be reconnected to the lower snaplock 30 of the first tool string.

A full functional operation of the CIRP System of FIG. 1 will be set forth below with reference to FIGS. 9–18 of the drawings. In the meantime, the structure of the snaplock connector 10, the deployment BOP 12, and the sealed ballistic transfer disposed within the third deployment stinger section of the snaplock connector 10 will be set forth below with reference to FIGS. 2–8 of the drawings.

Referring to FIGS. 2*a* and 2*b*, a three dimensional view of the first and second sections (not including the third deployment stinger section) of the snaplock connector 10 is illustrated.

In FIGS. 2*a*, the first section 10*a* of the snaplock connector 10 is adapted to be inserted into the second section 10*b* of the snaplock connector. The second section 10*b* is called the breech lock sleeve 10*b*, and the first section 10*a* is called the fork sub 10*a*. When the first section fork sub 10*a* is inserted into the second section breech lock sleeve 10*b* of snaplock connector 10, the resultant structure (known as the "lower snaplock") is shown in FIG. 2*b*. Therefore, FIG. 2*b* illustrates the lower snaplock 30 in FIG. 1, and the lower snaplock portion of the snaplock connector 10 of FIG. 1.

In FIG. 2*a*,note that the internal diameter of the second section breech lock sleeve 10*b* of FIG. 2*a* includes a plurality of internal buttress grooves 10*b*1 interleaved with a corresponding plurality of vertical slots 10*b*2. On the other hand, the outside diameter of the second section breech lock sleeve 10*b* of FIG. 2*a* includes a series of machined pinion teeth 10b3 which mate with teeth on the "robot arm rack" that is part of the deployment BOP 12.

In FIG. 2*a*, the first section fork sub 10*a* includes six fingers 10*a*1 which have buttress grooves machined on the outside diameter thereof. The buttress grooves on the fingers 10*a*1 of the first section fork sub 10*a* mate with the internal buttress grooves 10*b*1 on the second section breech lock sleeve 10*b* when the fingers 10*a*1 of the first section fork sub 10*a* are inserted into the second section breech lock sleeve 10*b*. The width of the fingers 10*a*1 is the same as the width of the vertical slots 10*b*2 inside the sleeve 10*b*. Furthermore, the first section fork sub 10*a* includes an undersized slick joint 10*a*2 and an external circumferential lock groove 10*a*3 which mates with the no-go and lock rams, respectively, of the deployment BOP 12. The second section breech lock sleeve 10*b* is secured to the first section fork sub 10*a* with a torsion spring 10*a*4. The torsion spring 10*a*4 holds the sleeve 10*b* in the locked position with a force of 20 ft-lbf (27 Newton-Meters). The sleeve 10*b* must be rotated to the unlocked position relative to the fork sub 10*a* (the rotation being implemented by the deployment BOP 12 robot arm) to permit the first section fork sub 10*a* of the snaplock 10 to be engaged with or disengaged from the second section breech lock sleeve 10*b*. A rotation stop 10*a*5 ensures full sleeve engagement with the fork sub fingers 10*a*1 and the deployment stinger (of FIG. 3) as well as providing for consistent locking and unlocking. The lower end of the slick joint 10*a*2 mates, for example, with the upper end of the gun string 28 of FIG. 1.

Referring to FIGS. 3*a* and 3*b*, a three dimensional view of the first fork sub section 10*a*, the second breech lock sleeve section 10*b*, and the third deployment stinger section 10*c* of the snaplock connector 10 is illustrated In FIG. 3*a*, the first fork sub section 10*a* and the second breech lock sleeve section 10*b* is again illustrated, the first section 10*a* and the second section 10*b* of FIG. 3*a* being identical to the first and second sections 10*a* and 10*b* set forth in FIG. 2*b*. However, in FIG. 3*a*, the third deployment stinger section 10*c* is illustrated.

The third deployment stinger section 10*c* of FIG. 3*a* includes the sealed ballistic transfer apparatus shown in FIG. 6 and discussed below with reference to FIG. 6. The lower end of the third deployment stinger section 10*c* includes a series of circumferential buttress grooves 10*c*1 machined on the outer periphery of the deployment stinger 10*c*. In addition, six vertical slots 10*c*2 are machined through the grooves 10*c*1, the grooves 10*c*1 on the outer periphery of the deployment stinger 10*c* being oriented to mate with the internal slots 10*b*2 of the second breech lock sleeve section 10*b* when the second section 10*b* of the snaplock connector 10 is twisted relative to the first section 10*a* of the snaplock connector 10. The upper end of the deployment stinger 10*c* (called the "upper snaplock 20" in FIG. 1) mates with the lower end of the gun section 18 of FIG. 1. Hereinafter, the third deployment stinger section 10*c* of the snaplock connector 10 is the Òupper snaplock", similar to upper snaplock 20 of FIG. 1, and the first and second sections 10*a* and 10*b* of the snaplock connector is the "lower snaplock", similar to the lower snaplock 30 in FIG. 1.

In FIG. 3*a*, when the pinion teeth 10*b*3 of the second section 10*b* of the snaplock connector 10 is twisted, by the deployment BOP 12, relative to the lock groove 10*a*3 of the first section 10*a*, the buttress grooves 10*c*1 on the outer periphery of the third deployment stinger section 10*c* may be inserted into the slots 10*b*2 of the second section 10*b*. Then, when the twisting force being applied to the pinion teeth 10*b*3 of second section 10*b* relative to the lock groove 10*a*3 of the first section 10*a* is released, the third deployment stinger section 10*c* is thereafter locked inside the second section 10*b*, and the second section 10*b* is further locked inside the first section 10*a*. The resultant structure is shown in FIG. 3*b*.

On the other hand, when the twisting force is again applied to the pinion teeth 10*b*3 of the second section 10*b* relative to the lock groove 10*a*3 of the first section 10*a* of the snaplock connector 10, the buttress grooves 10*c*1 of the third deployment stinger section 10*c* may be removed from the slots 10*b*2 of the second section 10*b*. At this point, the third section 10*c* is unlocked from the second section 10*b* of the snaplock connector and the third section 10*c* may be removed from the second section 10*b*; however, the second section 10*b* remains locked to the first section 10*a*.

When the twisting force applied to pinion teeth 10*b*3 relative to lock groove 10*a*3 is again released, the second section 10*b* may be removed from the first section 10*a* of the snaplock connector 10.

Figure 4:
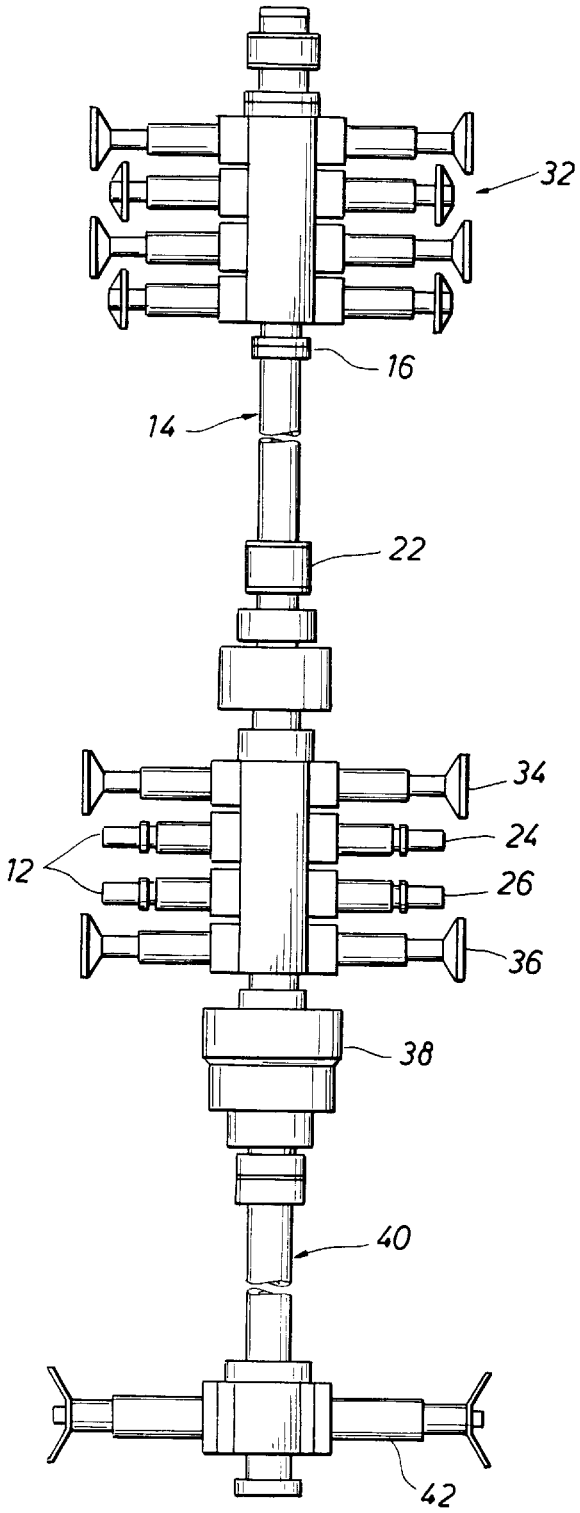
FIG. 4 illustrates a typical wellhead rig-up using a Completions Insertion and Retrieval under Pressure (CIRP) apparatus.

Referring to FIG. 4, a typical wellhead rig-up apparatus using the Completions Insertion and Retrieval under Pressure (CIRP) System of FIGS. 1–3 is illustrated.

FIG. 4 illustrates a typical rig-up apparatus which uses the CIRP System of the present invention. The rig-up apparatus of FIG. 4 includes a quad BOP 32, the pickup/laydown assembly 16 (of FIG. 1), the lubricator 14 (of FIG. 1), the master or gate valve 22 (of FIG. 1), a shear seal 34, the deployment BOP 12 (of FIG. 1) which includes the upper deployment BOP 24 (deployment guide Ram and Rack) and the lower deployment BOP 26 (deployment no-go Ram and Lock), a pipe/slip 36, an annular BOP 38, another lubricator 40, and a combi BOP 42. A functional operation in the use of the CIRP System of the present invention in connection with the rig-up apparatus of FIG. 4 will be set forth below with reference to FIGS. 9–18 of the drawings.

Figure 5:
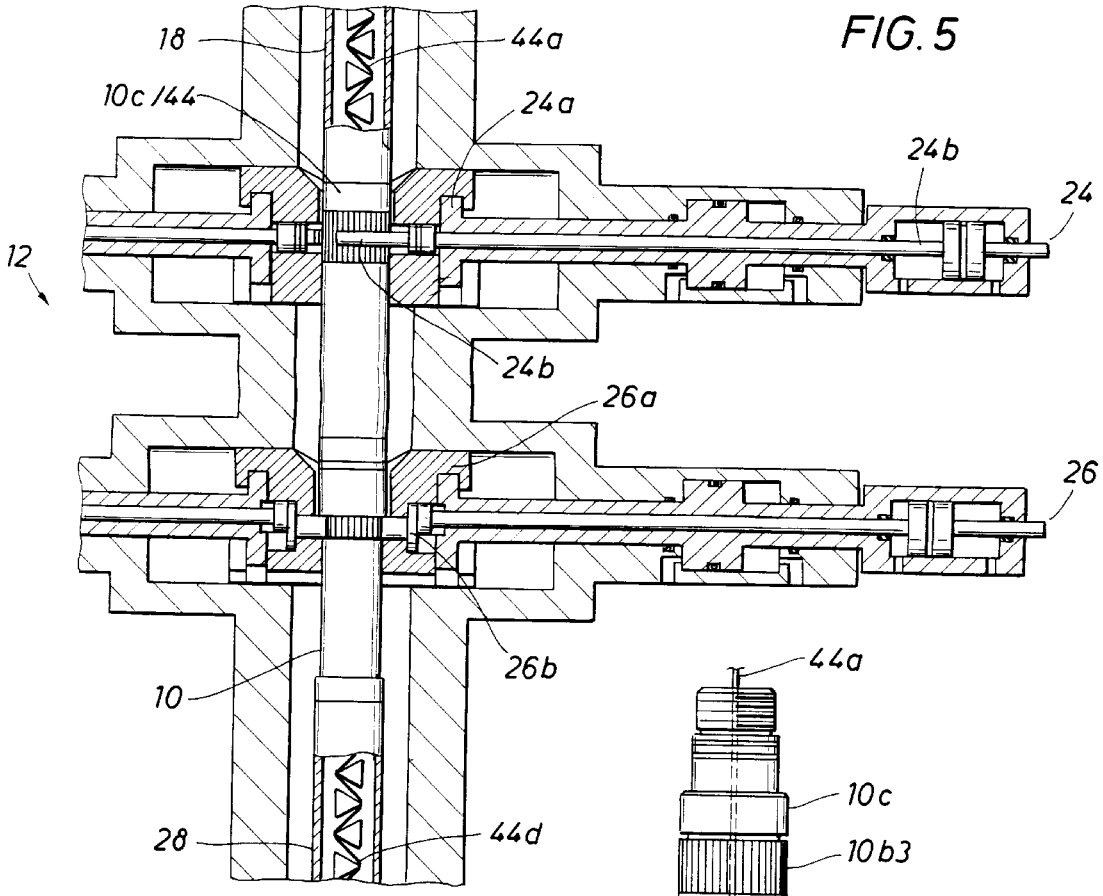
FIG. 5 illustrates a special Blow Out Preventer (BOP) required for the CIRP apparatus.

Referring to FIG. 5, the deployment BOP 12 of FIGS. 1 and 4, including the upper deployment BOP 24 and the lower deployment BOP 26, is illustrated in more detail in FIG. 5 of the drawings.

In FIG. 5, the upper deployment BOP 24 includes a guide ram 24*a* and a hydraulically actuated robot arm rack 24*b*. The lower deployment BOP 26 includes a no-go ram 26*a* and a locking ram 26*b*. The no-go ram 26*a* positions the snaplock 10 with respect to upper and lower rams. The locking ram 26*b* secures the snaplock 10 and prevents the string from rotating or moving vertically. The guide ram 24*a* centers the upper section of the snaplock 10 to facilitate connecting or disconnecting. The robot arm rack 24*b* engages and moves the breech lock sleeve 10*b* to a locked or unlocked position. Therefore, while the guide ram 24*a*, no-go ram 26*a*, and locking ram 26*b* maintain the snaplock 10 stationary, the robot arm and robot arm rack 24*b* of the upper deployment BOP 24 moves (that is, rotates) the second breech lock sleeve section 10*b* of FIG. 2*a* and 3*a* relative to the first fork sub section 10*a* of FIGS. 2*a* and 3*a* thereby locking the third deployment stinger section 10*c* to the first and section sections 10*a* and 10*b* of the snaplock connector in response to the rotation, by the upper deployment BOP 24, of the second section 10*b* relative to the first section 10*a* of the snaplock connector 10 in one rotational direction, and also unlocking the third section 10*c* from the first and second sections 10*a* and 10*b* of the snaplock connector 10 in response to the rotation, by the upper deployment BOP 24, of the second section 10*b* relative to the first section 10*a* of the snaplock connector 10 in an opposite rotational direction.

Figure 6:
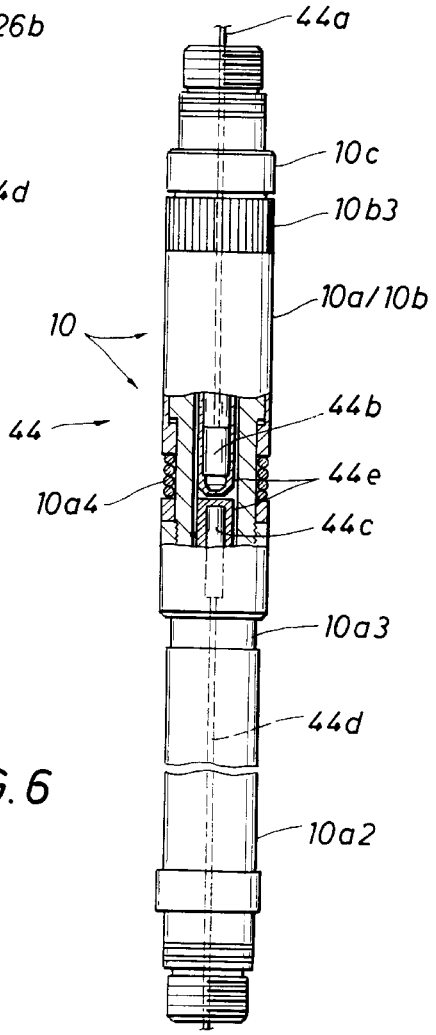
FIG. 6 illustrates the sealed ballistic transfer taking place in the snaplock connector.

Referring to FIG. 6, the sealed ballistic transfer unit 44 embodied within the third deployment stinger section 10*c* of the snaplock connector 10 is illustrated.

In FIG. 6, recall that the third deployment stinger section 10*c* and the first fork sub section 10*a* of the snaplock connector 10 in FIG. 3*a* include a "sealed ballistic transfer unit 44", and that the third deployment stinger section 10*c* is inserted into the second breech lock sleeve section 10*b*, the second section 10*b* being connected to the first section 10*a* of the snaplock connector 10. The ballistic transfer unit 44 transfers a detonation wave, propagating in a first detonating cord from the first detonating cord to a second detonating cord. See U.S. Pat. No. 5,123,356. In FIG. 6, the sealed ballistic transfer unit 44 is embodied within the third and first sections 10*c* and 10*a* of the snaplock connector 10 and it includes the first detonating cord 44*a* having an end which connects to a trigger charge 44*b* that is embodied within the third section 10*c* (a trigger charge is a downwardly pointing shaped charge). A receptor booster 44*c* is embodied in the first fork sub section 10*a* of the snaplock connector 10 and it is spaced by a distance from the trigger charge 44*b* in the third section 10*c*. The second detonating cord 44*d* also embodied within the first section 10*a* is connected to the receptor booster 44*c*. Pressure sealed covers 44*e* will seal the end of the trigger charge 44*b* and the end of the receptor booster 44*c*. When the trigger charge 44*b* in the third section 10*c* detonates in response to the detonation wave propagating in the first detonating cord 44*a*, a jet from the charge 44*b* will initiate a detonation wave in the receptor booster 44*c* of the first section 10*a*. The detonation wave from the receptor booster 44*c* in the first section 10*a* will propagate down the second detonating cord 44*d* through the slick joint 10*a*2. As a result, a detonation wave propagating in the first detonating cord 44*a* will be transferred to the second detonating cord 44*b* via the ballistic transfer unit 44.

Referring to FIGS. 7*a* through 7*f*, a gun string assembly using the CIRP System of the present invention is illustrated. This gun string assembly of FIGS. 7*a*–7*f* will be used during the discussion of a functional description of the operation of the CIRP System of the present invention set forth below with reference to FIGS. 1 through 7*f* of the drawings.

In operation, the pickup/laydown assembly 16 of FIG. 1 is required to handle individual gun sections, the pickup/laydown assembly 16 including a pickup/laydown sub, a short gun tube for weight, and the upper section of the snaplock connector 10 consisting of the third deployment stinger section 10*c*. Starting the process of connecting gun string sections involves closing the master valve/gate valve 22 of FIGS. 1 and 4 which is situated above the deployment BOP 12 of FIGS. 1 and 4. The lubricator 14 of FIGS. 1 and 4 is vented (internal pressure is released to the atmosphere) and the quick disconnect is released. The lubricator 14 assembly is removed from the stack and then the pickup/laydown assembly 16 is lowered out of the lubricator 14, at which point, the laydown assembly 16 is connected to first (lowermost) gun section 28 in FIG. 1. The string assembly consisting of the laydown assembly 16 and first gun section 28 is pulled back into the lubricator 14. The lubricator 14 is connected to the stack and is pressure tested. The master valve/gate valve 22 is opened, and the gun section 28 is ready to be lowered into the deployment BOP 12 stack. The step-by-step procedure for connecting gun sections is illustrated in FIGS. 7*a*–7*f*.

Figure 7A:
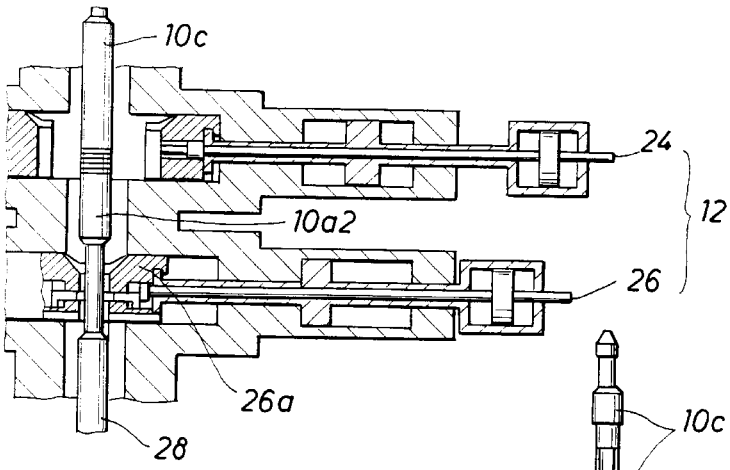
Figure 7B:
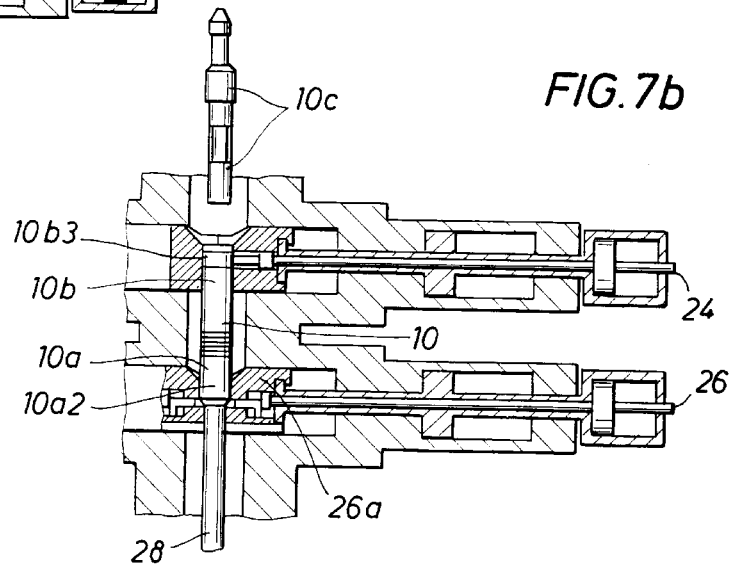

In FIGS. 7*a* and 7*b*, the gun section 28 is lowered until the slick joint 10*a*2 (the lowermost part of the first section 10*a*) of the snaplock connector 10 is positioned in the no-go ram 26*a* of the lower deployment BOP 26 of the deployment BOP 12. When the "deployment receiver" of the snaplock connector 10 (the first and second sections 10*a* and 10*b* of the snaplock connector 10 shown in FIG. 2*b*) shoulders on the no-go ram 26*a* of the lower deployment BOP 26, the no-go ram 26*a* is closed and the locking ram 26*b* of the lower deployment BOP 26 is extended thereby locking the gun section 28 in place within the deployment BOP 12. In FIG. 7*b*, when the first and second sections 10*a* and 10*b* of the snaplock connector 10 of the "deployment receiver" are resting on the no-go ram 26*a*, the pinion teeth 10*b*3 of the second section 10*b* (the breech lock sleeve section 10*b*) are aligned with the robot arm rack 24*b* of the upper deployment BOP 24. The guide ram 24*a* is then closed to align the sections of the snaplock connector to facilitate disconnection and connection. The robot arm rack 24*b* is extended (rotating the pinion teeth 10*b*3 of the second section 10*b* of the snaplock connector 10 relative to the lock groove 10*a*3 of the first section 10*a*) thereby unlocking the second breech lock sleeve section 10*b* from the third deployment stinger section 10*c*. The pickup/laydown assembly 16 of FIG. 1 can now be lifted thereby withdrawing the deployment stinger 10*c* of FIG. 7*b* from the second breech lock sleeve section 10*b* of the deployment receiver located at the top of the first gun string 28.

Figure 7C:
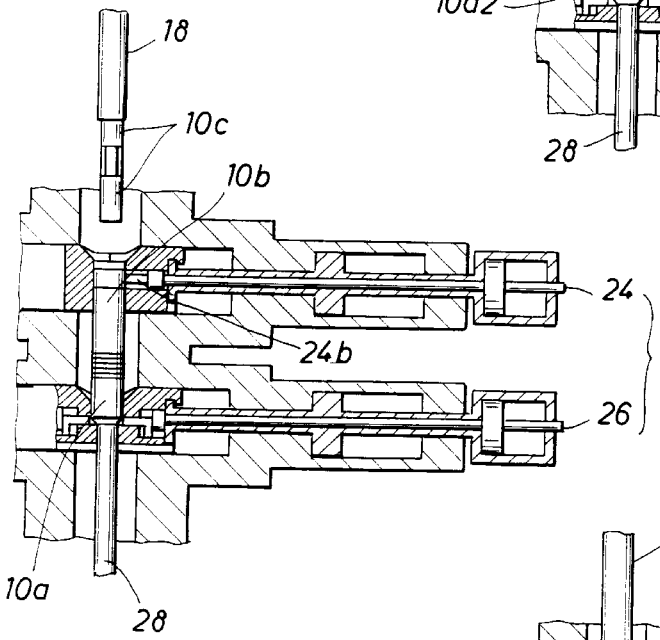
Figure 7D:
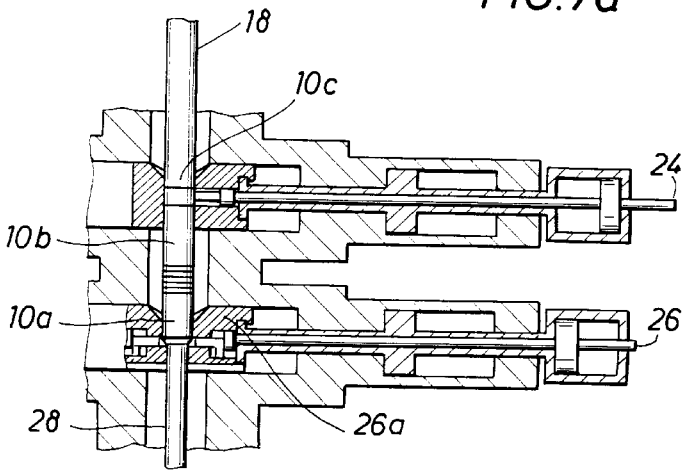

The process of removing the lubricator 14, connecting the next gun section 18 to the pickup/laydown assembly 16, and reinstalling and testing the lubricator 14 is performed. The master valve/gate valve 22 is opened and the connection operation continues. In FIGS. 7*c* and 7*d*, the second gun section 18 is lowered into the deployment BOP 12. The deployment stinger 10*c* on the new gun section 18 is stabbed into the second section 10*b* of the deployment receiver secured in the deployment BOP 12. The robot arm rack 24*b* is retracted, thereby locking the third deployment stinger section 10*c* to the second breech lock sleeve section 10*b* of the snaplock connector. Tension is applied to the gun string 18 to confirm that the two sections (third section 10*c* and and second section 10*b* of snaplock connector 10) are properly engaged. As a result, the second gun section 18 is now connected to the first gun string 28, as shown in FIG. 1. The no-go ram 26*a* is still closed.

In FIGS. 7*e* and 7*f*, now that connection of the second gun section 18 to the first gun string 28 is confirmed, the tension, being applied to the gun string 18, is released, and the upper and lower rams (the no-go ram 26*a* and the locking ram 26*b*) are retracted. The string is lowered until the next snaplock connector 10 is positioned in the deployment BOP stack 12, as shown in FIGS. 7*e* and 7*f* (when the next snaplock 10 is positioned in the BOP stack 12, the second gun string 18 is located below the lower deployment BOP 26 in FIG. 7f). The no-go ram 26*a* is closed and the above referenced process is repeated until the entire perforating gun string is assembled. The steps of retrieval of a perforating gun string from within a wellbore are the reverse of the foregoing. The cycle of connecting one gun section requires about 30 minutes.

Referring to FIG. 8, a more detailed construction of the snaplock connector 10 of FIGS. 3*a* and 3*b* is illustrated.

In FIG. 8, the snaplock connector 10 is shown with the first section 10*a*, the second section 10*b*, and the third section 10*c* all connected together, as also shown in three dimensions in FIG. 3*b*. However, FIG. 8 represents a cross-sectional view of the snaplock connector 10 of FIG. 3*b*; therefore, FIG. 8 will illustrate the snaplock connector 10 in much greater detail.

The snaplock connector 10 of FIG. 8 includes the first fork sub section 10*a* which includes the fingers 10*a*1 and the slick joint 10*a*2, the fingers 10*a*1 being inserted into the slots 10*b*2 (in FIG. 2*a*) of the second breech lock sleeve section 10*b*. When the fingers 10*a*1 of the first section 10*a* are inserted into the slots 10*b*2 of the section section 10*b* of the snaplock connector 10, and when the second section 10*b* is twisted while the first section 10*a* is stationary, the torsion spring 10*a*4 will resist the twisting force applied to the second section 10*b* relative to the first section 10*a*. In FIG. 8, the buttress grooves 10*c*1 of the third deployment stinger section 10*c* are inserted into the slots 10*b*2 (see FIG. 2*a*) of the second section 10*b* when the twisting force is applied to the second section 10*b* (by the deployment BOP 12) while the first section 10*a* is stationary. The deployment stinger section 10*c* includes the detonating cord 44*a* which terminates at the trigger charge 44*b*. On the other hand, the first fork sub section 10*a* includes the receptor booster 44*c* which is also connected to another detonating cord 44*d*. When a detonation wave propagating in the first detonating cord 44*a* detonates the trigger charge 44*b* in the third section 10*c*, a jet from the trigger charge 44*b* initiates the propagation of a detonation wave in the receptor booster 44*c* in the first section 10*a* of the snaplock connector 10, causing another detonation wave to propagate from the receptor booster 44*c* down the second detonating cord 44*d*.

Referring to FIGS. 9 through 18, a functional description of the operation of the Completions Insertion and Retrieval under Pressure (CIRP) System of the present invention, including use of the snaplock connector 10, will be set forth in the following paragraphs with reference to FIGS. 9 through 18 of the drawings, and with further reference to FIGS. 1–6.

Figure 9:
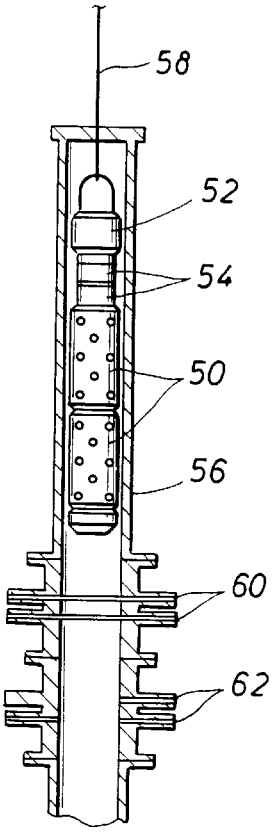
FIGS. 9 through 18 illustrate a method and apparatus in accordance with one aspect of the present invention for running and retrieving long perforating gun strings into a wellbore under pressure with one trip into the wellbore.
Figure 10:
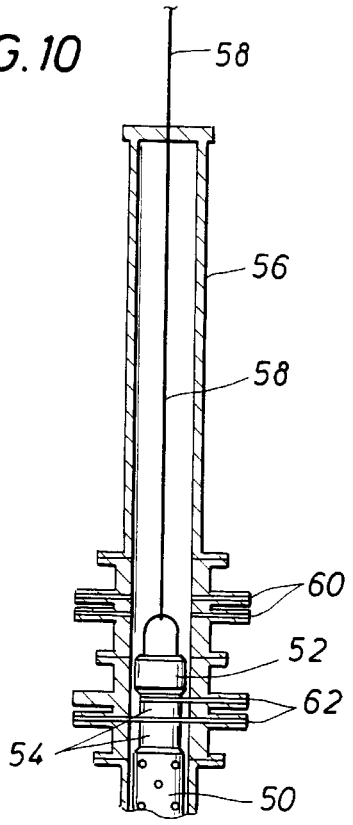

In FIGS. 9 and 10, beginning with FIG. 9, a first lift 50, that is, a "first lift", consisting of a first bottom perforating gun string 50, a pickup and lay down assembly 52, and a snaplock connector 54 interconnected between the gun string 50 and the assembly 52, is inserted inside the lubricator 56. The first lift suspends by a wireline 58 in the lubricator 56. The lubricator 56 is slowly pressurized to a pressure equal to the wellhead pressure. When the lubricator 56 pressure equals the wellhead pressure, the master valves 60 are opened. When the master valves 60 are opened, the first lift is lowered into the well until the slick joint 10*a*2 (see FIG. 2*a*) of the snaplock connector 54 is opposite the no-go rams 26*a* (see FIG. 5) of the deployment BOP stack 62 (see deployment BOP 12 of FIG. 5). At this time, the no-go rams 26*a* (of FIG. 5) are closed onto the slick joint 10*a*2 (of FIG. 2*a*) and the first lift is slowly lowered until it stops. It will stop when the lock groove 10*a*3 (of FIG. 2*a*) at the top of the slick joint 10*a*2 reaches the ram 26*a*. The lock ram 26*b* (of FIG. 5) is then closed, as best shown in FIG. 10, to prevent movement in the lower section of the snaplock and locking it against rotation. Next, the guide rams 24*a* (of FIG. 5) are extended to centralize the upper end of the snaplock 54. A pull test is performed to be sure the snaplock 54 is secured in the proper position within the BOP 62. The weight of the gun string 50 is hung-off onto the rams 24*a*. Then, in FIG. 10, the robot arm 24*b*, of FIG. 5, is extended to rotate the snaplock connector 54 second breech lock sleeve section 10*b*, relative to the first section 10*a* of the snaplock connector 54, to the unlocked position.

Figure 11:
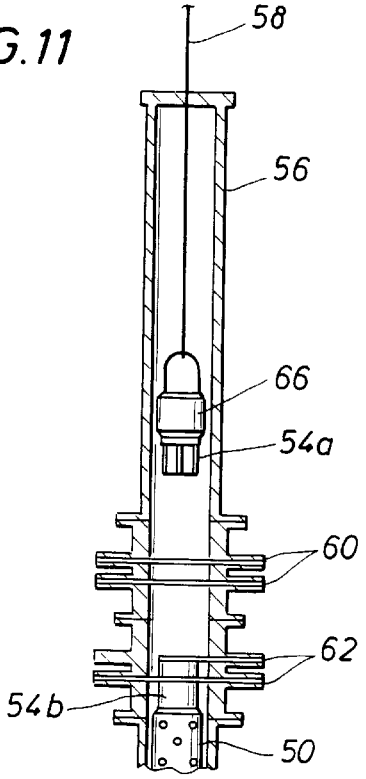

In FIG. 11, when the second section 10*b* of the snaplock connector 54 is rotated relative to the first section 10*a*, the upper half 54*a* of the snaplock connector 54 (the upper half 54*a* being the third section 10*c* of snaplock connector 10) is then slowly pulled out of the lower half 54*b* of the snaplock connector 54 (the lower half 54*b* being the first and second sections 10*a* and 10*b* of snaplock connector 10) by pulling on the wireline cable 58. Recall that the lower half 54*b* of snaplock connector 54 is being firmly held within the deployment BOP 62. When the upper half 54*a* of the snaplock connector 54 is safely disposed within the lubricator 56 (above the top of the BOP stack 62 and the valve 60), the master valve(s) 60 are closed. When the master valves 60 are closed, the pressure inside the lubricator 56 is slowly bled off. When there is no pressure in the lubricator 56, the upper half 54*a* of the snaplock connector 54, along with the pickup and laydown assembly 52, is removed from the lubricator 56 and a "second lift" is loaded into the lubricator 56.

Figure 12:
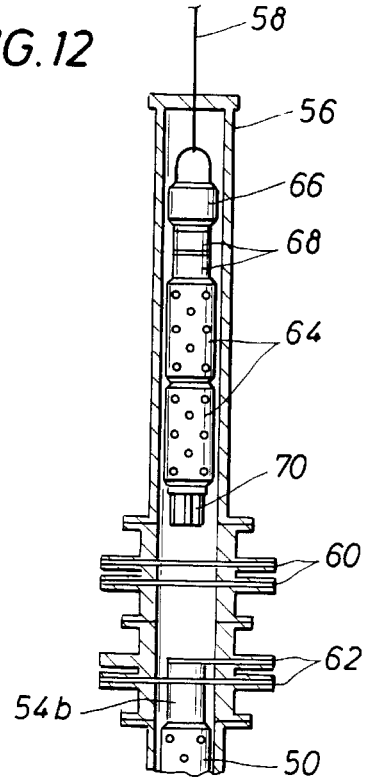

In FIG. 12, the "second lift" loaded into the lubricator 56 comprises: another pickup/laydown assembly 66, another snaplock connector 68, another perforating gun string 64, and another upper half 70 of a snaplock connector (the upper half 70 being another third deployment stinger section 10*c* as shown in FIG. 3*a*). The lower half 54*b* of the snaplock connector 54 of FIG. 11 is still being firmly held within the deployment BOP 62. With the "second lift" inside the lubricator 56 and with the master valve 60 still closed, the lubricator 56 is reconnected to the BOP stack 62 and the lubricator 56 is slowly brought up to wellhead pressure. When the lubricator 56 pressure equals the wellhead pressure, the master valve(s) 60 are opened.

Figure 13:
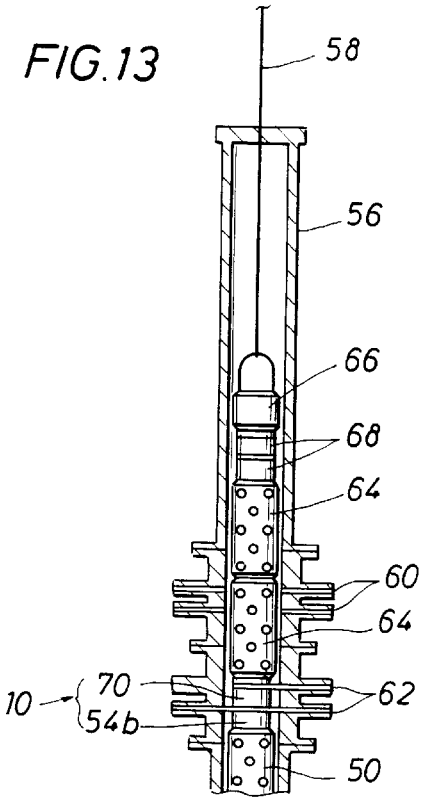

In FIG. 13, with the master valve 60 opened, the second lift of FIG. 12 is lowered until the upper half 70 of the snaplock connector on the lower end of the perforating gun string 64 is inserted into the lower half 54*b* of the snaplock connector which is currently being held within the BOP stack 62. That is, the upper half 70 is a deployment stinger, like the deployment stinger 10*c* shown in FIG. 3*a*, and the deployment stinger 70 of FIGS. 12 and 13 is inserted into the lower half 54*b* of the snaplock connector held in the BOP stack 62. The lower half 54*b* is actually the first section 10*a* and the second section 10*b* of the snaplock connector 10 shown in FIG. 2*b*. Together, the upper half 70 and lower half 54*b* represent a snaplock connector 10.

Now that the upper half 70 is inserted into the lower half 54*b* as shown in FIG. 13, it is necessary to lock the upper half 70 to the lower half 54*b*. This is accomplished by retracting the robot arm 24*b* of the deployment BOP 62 which engages the second breech lock sleeve section 10*b* of the lower half 54*b*. By retracting the robot arm 24*b*, the torsion spring 10*a*4 is relieved of the twisting force which was previously provided by the robot arm 24*b*, and the second section 10*b* rotates back with respect to the first section 10*a* of the snaplock connector 70/54*b*. The cable 58 is raised for the purpose of applying a pull to the snaplock connector 70/54*b* to be sure it is engaged. The guide ram, lock rams, and no-go rams (see FIG. 5) of the BOP stack 62 (the deployment BOP 12) are opened, and then the "second lift" shown in FIG. 13 is lowered until slick joint 10*a*2 of the snaplock connector 68 (between the top of the second lift and the pick up and lay down assembly 66) is disposed opposite the no-go ram 26*a* of the BOP stack 62, as shown in FIG. 14.

Figure 14:
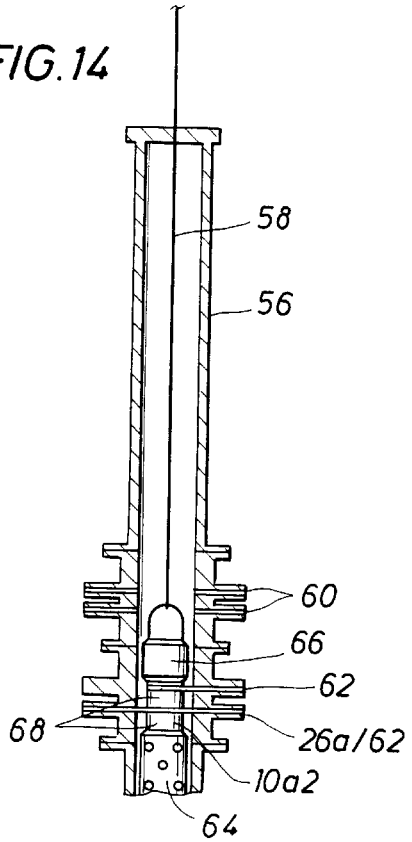

In FIG. 14, the objective at this point is to pull the pickup and laydown assembly 66 and the upper half (section 10*c*) of the snaplock connector 68 out of the lower half (sections 10*b* and 10*a*) of the snaplock connector 68. To do this, the no-go rams 26*a* are closed on the slick joint 10*a*2 of the snaplock connector 68, and the string is lowered until it stops (the lock groove 10*a*3 reaches the ram). The lock ram 26*b* is closed to prevent rotation of the lower section (first section 10*a*) of the snaplock 68. The guide ram 24*a* is extended to centralize the upper end (section 10*b*) of the snaplock 68. After a pull test is performed, the weight of the gun string 64 is then hung-off on the rams. Then, the robot arm 24*b* of the BOP stack 62 is extended to rotate the second breech lock sleeve section 10*b* of the snaplock 68 relative to the first section 10*a*. This rotation unlocks the snaplock 68, and, when the snaplock 68 is unlocked, the upper half 68*a* of the snaplock 68 (the third deployment stinger section 10*c*) is then slowly pulled out of the lower half 68*b* (first section 10*a* and second section 10*b*) of the snaplock 68 using the cable 58, as shown in FIG. 15.

Figure 15:
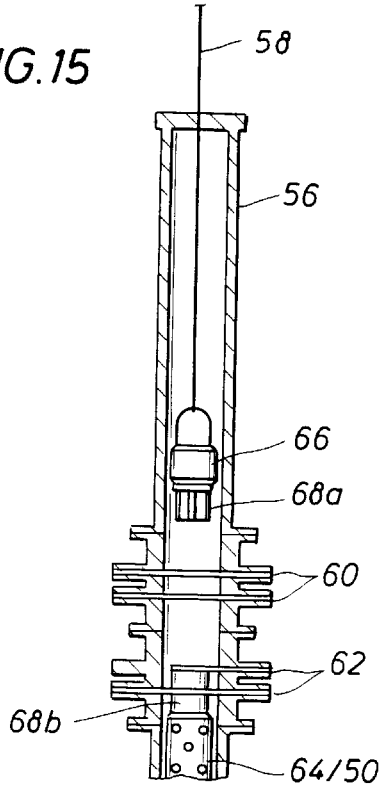

In FIG. 15, when the upper half 68*a* (third deployment stinger section 10*c*) of the snaplock 68 clears the BOP stack 62 (FIG. 14 and 15), the master valve 60 is closed. With the master valve 60 closed, the pressure on the lubricator 56 is slowly bled off. When there is no pressure on the lubricator 56, the lubricator 56 is removed and the next lift is loaded into the lubricator. This sequence is repeated as necessary to run the desired length of perforating guns into the wellbore.

Figure 16:
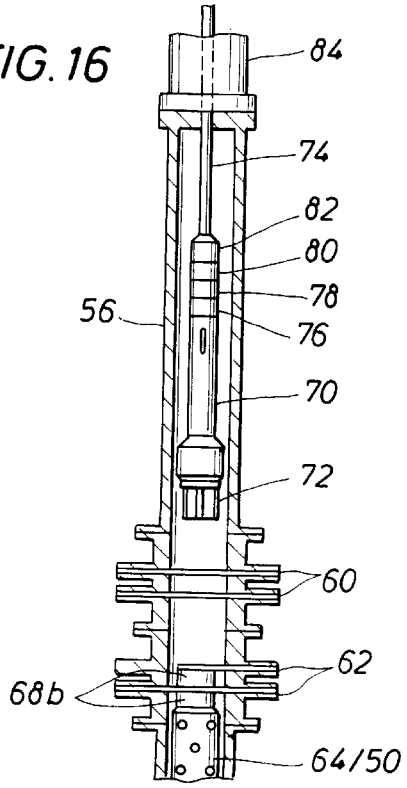

In FIG. 16, the next to last lift is the safety spacer with a snaplock connector looking up. After the safety spacer is landed and locked in the no-go ram of the BOP stack 62, the pickup and laydown assembly 66 is laid down, the wireline stuffing box is removed from the lubricator 56, and the lubricator 56 is attached to a coiled tubing injector 84. A coiled tubing firing head 70, having a snaplock connector deployment stinger 72 (third section 10*c* of FIG. 3*a*) located at the bottom of the firing head 70, is prepared and attached to the bottom of a coiled tubing 74 (after the coiled tubing 74 is injected into the lubricator 56 by the coiled tubing injector 84), as shown in FIG. 16. A firing head upper adaptor 76, a coiled tubing swivel 78, a dual flapper valve 80, and a coiled tubing end adaptor 82 are interconnected between the firing head 70 and the bottom of the coiled tubing 74. The lubricator 56 is attached to the master valves 60 and to the BOP stack 62. If it is desired to pressure test the firing head 70, it can be safely done at this time, with the firing head 70 in the lubricator 56, not attached to the gun string 64/50. After testing, the lubricator 56 is equalized with the wellhead pressure. With the master valves 60 open, the firing head 70 is lowered past the valves 60, and the snaplock connector upper half (deployment stinger) 72 is inserted into lower half 68*b* (first section 10*a* and second section 10*b*) of the snaplock 68 which is currently hung off the no-go ram 26*a* of the deployment BOP 62. When the upper half deployment stinger 72 is inserted into the lower half 68*b*, the robot ram 24*b* is retracted thereby engaging the breech lock sleeve 10*b* (second section 10*b*) of the lower half 68*b* with the upper half deployment stinger 72 (third section 10*c*).

Figure 17:
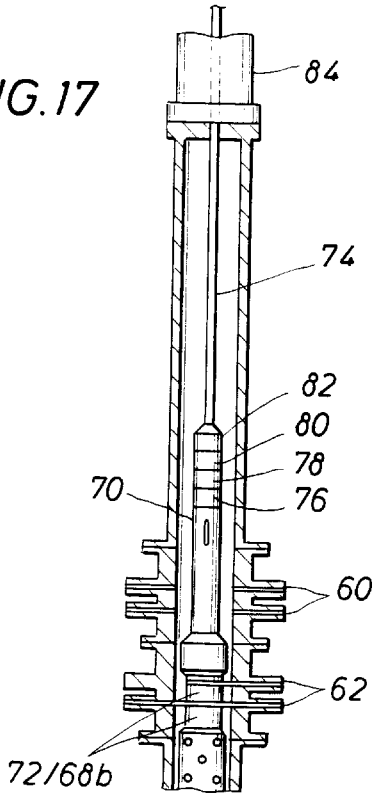
Figure 18:
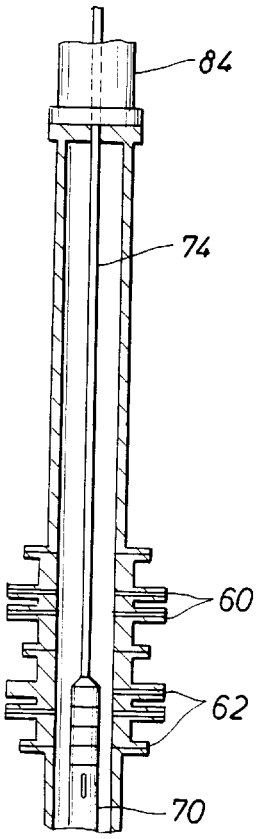

In FIGS. 17 and 18, when the snaplock connector 72/68*b* in FIG. 16 is engaged, the pull on the coiled tubing 74 is decreased until the pull on the coiled tubing 74 is equal the weight of the gun string 64/50, and the guide rams 24*a*, lock rams 26*b*, and no-go rams 26*a* of the deployment BOP 62 are all opened. With the no-go ram 26*a* open, the tool string shown in FIG. 18 consisting of the coiled tubing 74, the firing head 70, the snaplock connector 72/68*b*, and the perforating gun string 64/50 is lowered into the well, as best shown in FIG. 18.

Figure 19:
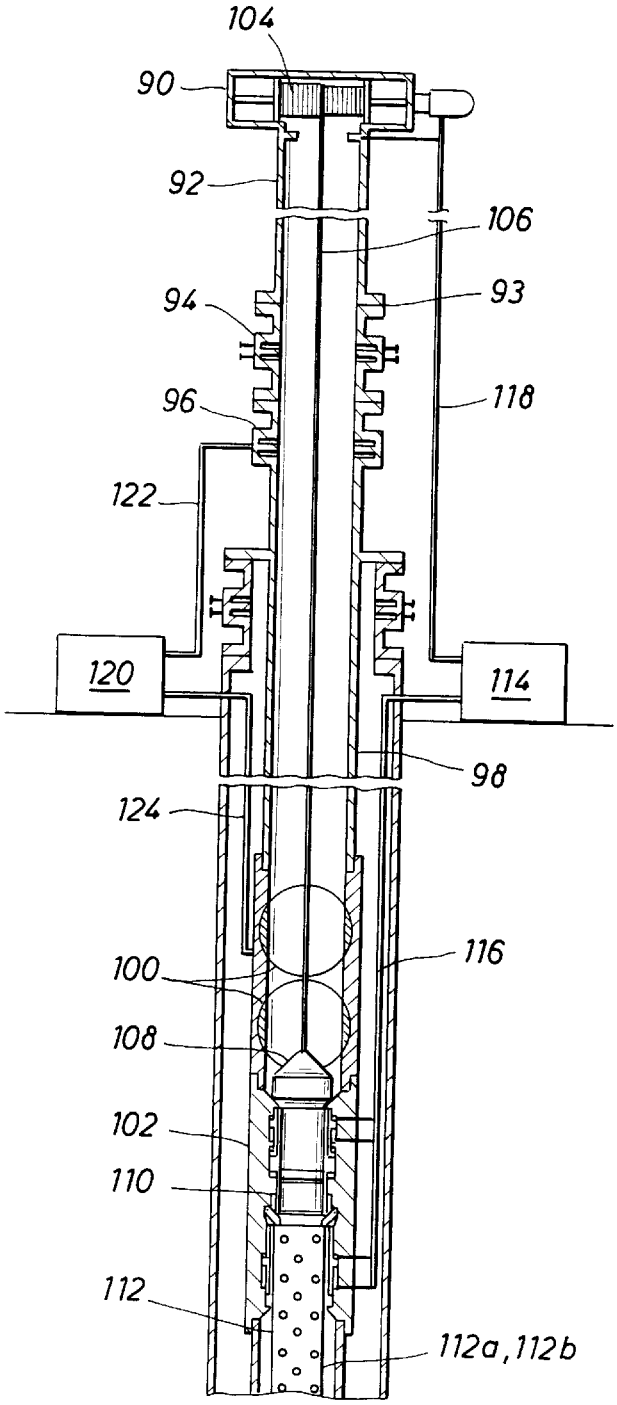
FIG. 19 illustrates a further alternate apparatus in accordance with another aspect of the present invention for running and retrieving long perforating gun strings into the wellbore under pressure with one trip into the wellbore, this apparatus including a snaplock operator.

Referring to FIGS. 19, a further alternate apparatus, in accordance with another aspect of the present invention, for running long perforating gun strings into a wellbore under pressure with one trip into the wellbore, is illustrated. This further alternate apparatus includes the novel snaplock operator.

In FIG. 19, the further alternate apparatus replaces the deployment BOP 12 of FIGS. 1–7*f* and the deployment BOP 62 in FIGS. 9–18 with a snaplock operator. The advantages of this alternate apparatus of FIG. 19 include the following: it is round; it contains only two hydraulic cylinders working in the axial direction, not radially like the eight hydraulic cylinders in the snaplock deployment BOP 12/62; it operates a standard snaplock connector 10; it allows snaplock connectors to be located further apart with conventional make-up and break-up between connectors; and it allows for faster running of the perforating gun string or other tools. Combining the new snaplock operator with the new pressurized winch lubricator discussed later provides optimum efficiency and maximum safety at maximum running speed.

In FIG. 19, the alternate apparatus includes a pressurized winch 90 having a reel 104 of wireline cable 106 rolled up inside the winch 90, the winch 90 being disposed on top of a lubricator 92. In the past, the cable was injected into a stuffing box disposed atop the lubricator. A hole was disposed atop the stuffing box for allowing the cable to enter the stuffing box and lubricator. A seal was necessary inside the hole in the stuffing box to seal the cable to the hole in the stuffing box when the lubricator was being pressurized. It was difficult to maintain a proper seal inside that hole. The novel pressurized winch 90 eliminates the need for the hole and eliminates the aforementioned problem of sealing the cable in the hole.

Reviewing the alternate apparatus of FIG. 19 from top down, the lubricator 92 is connected to master valves 94 at connection 93, and the master valves 94 are connected to a standard BOP stack 96 like the deployment BOP 12 of FIGS. 1–7*f* and the BOP stack 62 of FIGS. 8–18. The BOP stack 96 is connected to a work string 98. The work string 98 is further connected to downhole valves 100. The downhole valves 100 are connected to a snaplock operator 102. The snaplock operator 102 provides the necessary twisting force to pinion teeth 10*b*3 of the second breech lock sleeve section 10*b* of the snaplock connector 10 of FIG. 2*a*, while the lock groove 10*a*3 of the first fork sub section 10*a* of the snaplock connector 10 remains stationary, for the purpose of locking the third deployment stinger section 10*c* to the second section 10*b* and unlocking the third section 10*c* from the second section 10*b* of the snaplock connector 10.

The winch 90 includes a reel 104 onto which one end of a wireline cable 106 (or electrical cable) is wound. The other end of the wireline cable 106 is connected to a snaplock running and positioning tool 108, and the running and positioning tool 108 is connected to the snaplock connector 110. One or more perforating guns 112 (or other tools, such as packers or setting tools) are connected to the snaplock connector 110. Note in FIG. 19 that the snaplock operator 102 is disposed below the downhole valves 100; therefore, when the snaplock connector 110 is disposed inside the snaplock operator 102, the snaplock connector 110 is disposed below the downhole valves 100 in the wellbore. A winch and snaplock operator control panel 114 is connected to the snaplock operator 102 via one or more snaplock operator hydraulic control lines 116 (and to the prime mover of the winch 90 via winch control and sensor lines 118). In addition, a coiled tubing BOP and downhole valves control panel 120 is connected to the coiled tubing BOP stack 96 via coiled tubing BOP hydraulic control lines 122 and to the downhole valves 100 via downhole valves hydraulic control lines 124. The hydraulic control lines 116, 118, 122, and 124 provide a pressurized hydraulic fluid to their respective receiving apparatus.

Referring to FIGS. 20*a* through 20*h*, the snaplock operator 102 of FIG. 19 is shown in greater detail.

Figure 20A:
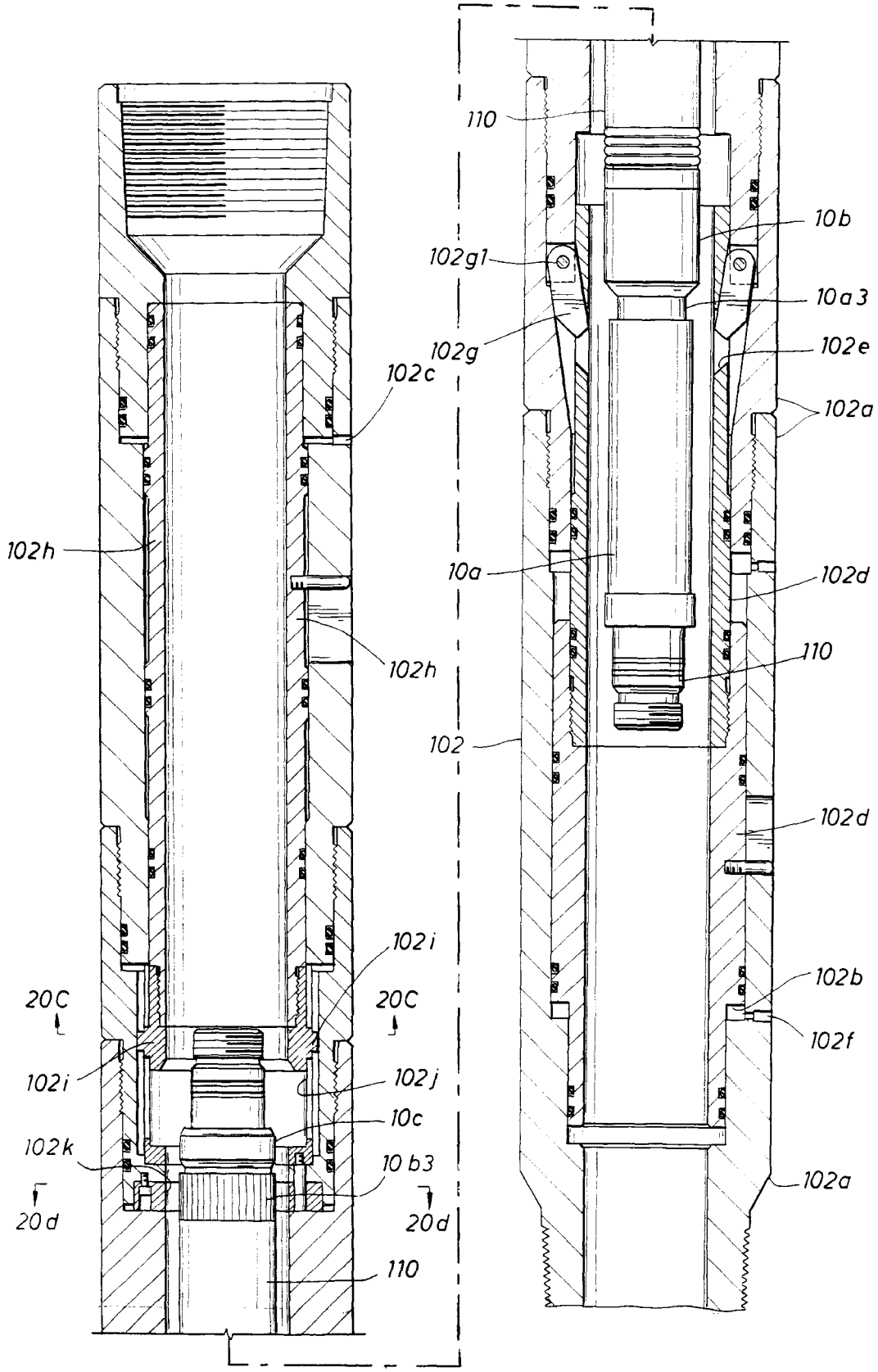
Figure 20E:
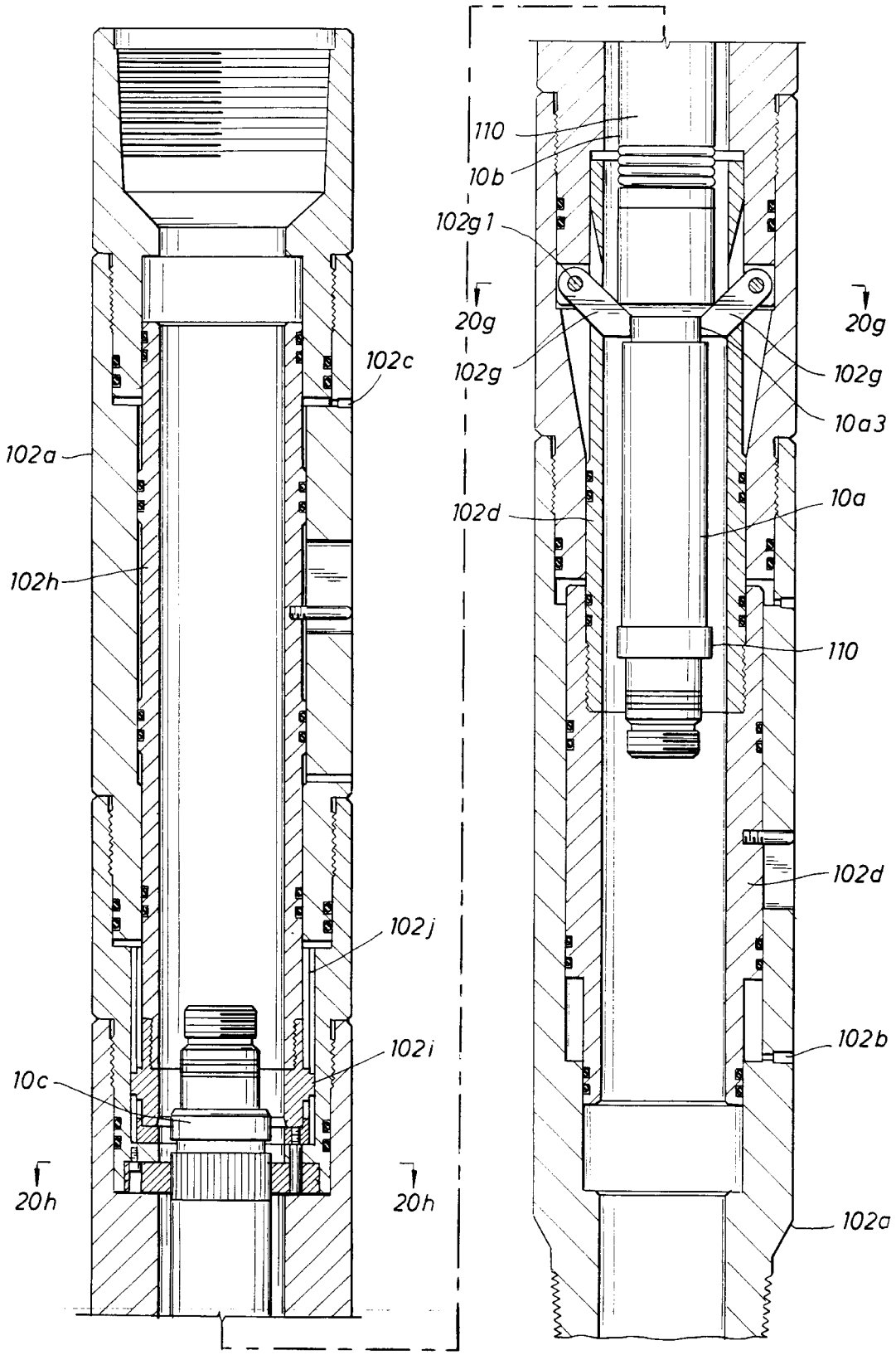

In FIGS. 20*a* and 20*e*, starting with FIG. 20*a*, the snaplock operator 102 includes an outer housing 102*a* having a first port 102*b* and a second port 102*c* disposed through the housing 102*a*. A first piston 102*d* is enclosed by and is disposed in contact with the housing 102*a*. The first piston 102*d* includes an end 102*e*. The first port 102*b* fluidly communicates with a shoulder 102*f* of the first piston 102*d* and, when a fluid pressure is applied to the shoulder 102*f*, the first piston 102*d* including its end 102*e* will move longitudinally within the snaplock operator 102. When the end 102*e* of the first piston 102*d* moves, the end 102*e* will contact a set of four slips 102*g*, each of the slips 102*g* being hinged to the outer housing 102*a* at hinge point 102*g*1. When the end 102*e* of piston 102*d* contacts the slips 102*g*, the slips 102*g* will each bend outwardly (as shown in FIG. 20*e*) and contact the lock groove 10*a*3 of the first section 10*a* of the snaplock connector 10 of FIG. 3*a*.

In FIG. 20*g*, note the four slips 102*g*. FIG. 20*g* illustrates a cross section of the snaplock operator 102 in FIG. 20*a* and FIG. 20*e*, the cross section being taken along section lines 20*g*—20*g* of FIG. 20*e*.

In FIG. 20*a*, a second piston 102*h* is also enclosed within the housing 102*a*, the second piston 102*h* being located at the opposite end of the snaplock operator 102 relative to the first piston 102*d*. The second port 102*c* fluidly communicates with the second piston 102*h*; when the second port 102*c* fluidly communicates with the second piston 102*h*, the second piston 102*h* will move longitudinally within the snaplock operator 102. The second piston 102*h* includes a ring 102I which slides inside a slot 102*j*, the slot 102*j* being situated inside an internal periphery of the outer housing 102*a*.

The ring 102I and slot 102*j* are better illustrated in FIGS. 20*b*, 20*c*, and 20*f* of the drawings. FIGS. 20*b* and 20*f* represent view of the ring 102I and slot 102*j* when the internal periphery of the outer housing 102*a* is laid flat on a surface. FIG. 20*c* illustrates a cross section of FIG. 20*a* taken along section lines 20*c*—20*c* of FIG. 20*a*, FIG. 20*c* illustrating the ring 102I.

A rack 102*k* is located at the end of the slot 102*j* on the internal periphery of the outer housing 102*a*. The rack 102*k* is better illustrated in FIGS. 20*d* and 20*h* of the drawings, FIG. 20*h* being a cross sectional view of FIG. 20*e* taken along section lines 20*h*—20*h* of FIG. 20*e*, and FIG. 20*d* being a cross sectional view of FIG. 20*a* taken along section lines 20*d*—20*d* of FIG. 20*a*. The rack 102*k* will contact the pinion teeth 10*b*3 on the external surface of the second section 10*b* of the snaplock connector 110 when the ring 102I begins to slide in the slot 102*j* in response to a movement of the second piston 102*h*. The second piston 102*h* will move when enough fluid pressure is exerted on the piston 102*h* from the fluid in the second port 102*c*.

A functional description of the operation of the alternate apparatus of FIG. 19, for running long perforating gun strings into a wellbore under pressure with one trip into the wellbore, and the snaplock operator 102 of FIGS. 20*a*20*h* when used in the apparatus of FIG. 19, will be set forth in the following paragraphs with reference to FIGS. 19 through 20*h* of the drawings, and with occasional reference to FIGS. 1–6 of the drawings.

Assume that a single perforating gun 112 is suspending by cable 106 within the snaplock operator 102 below the downhole valves 100 exactly as shown in FIG. 19. The guns 112 are being held firmly in place within the snaplock operator 102 by the four slips 102*g* as shown in FIG. 20*e*. Therefore, since the four slips 102*g* hold the guns 112 in place, the snaplock operator control lines 116 are hydraulically energized for pressurizing the first port 102*b* in FIG. 20*a*, the hydraulic fluid pressure being exerted against shoulder 102*f* in FIG. 20*a* for moving the first piston 102*d* thereby causing the end 102*e* of the first piston 102*d* to contact and extend the slips 102*g*. However, the positioning tool 108 (representing the third section 10*c* of the snaplock connector 10) is still locked within the first and second sections 10*a* and 10*b* of the snaplock connector 110 in FIG. 19.

Unlocking the Positioning Tool 108

To unlock the positioning tool 108 from the first and second sections 10*a* and 10*b* of the snaplock connector 110, the hydraulic fluid in the snaplock operator control lines 116 of FIG. 19 will enter the second port 102*c* in FIG. 20*a* thereby moving the second piston 102*h* from the position shown in FIG. 20*a* to the position shown in FIG. 20*e*. When the piston 102*h* moves to the position shown in FIG. 20*e*, the ring 102I located at the end of the piston 102*h* will slide in the slot 102*j*, the ring 102I sliding in the slot 102*j* from the position shown in FIG. 20*b* to the position shown in FIG. 20*f*. As the ring 102I slides within the slot 102*j*, the rack 102*k* will extend inwardly from its position shown in FIGS. 20*a* and 20*d* to the position shown in FIGS. 20*e* and 20*h*; and, when this happens, the rack 102*k* will contact the pinion teeth 10*b*3 situated on the outer periphery of the second breech lock sleeve section 10*b* of the snaplock connector 110. As the ring 102I continues to slide within the slot 102*j*, the rack 102*k* continues to contact and rotate the pinion teeth 10*b*3 on the section section 10*b* of the snaplock connector. Recalling that the four extended slips 102*g* of FIG. 20*e* are firmly holding the first fork sub section 10*a* of the snaplock connector 110 in the lock groove 10*a*, the second section 10*b* of snaplock connector 110 is rotating with respect to the first section 10*a*, thereby achieving the position shown in FIG. 20*e* and unlocking the positioning tool 108 from the first and second sections 10*a* and 10*b* of the snaplock connector 110.

Removal of Positioning Tool

In FIG. 19, the positioning tool 108 (the third deployment stinger section 10*c*) can now be removed from the first and second sections 10*a* and 10*b* of the snaplock connector 110 leaving the lower half of the snaplock connector (sections 10*a* and 10*b*) and the perforating guns (or other wellbore apparatus) 112 firmly held by the snaplock operator 102 within the snaplock operator 102. For purposes of the following discussion, assume that the perforating gun 112 is really a first perforating gun 112*a*. The winch 90 can now raise the positioning tool 108 upwardly into the work string 98.

Lowering a Second Perforating Gun Downhole

The lubricator 92 is disconnected, at connection 93, from the master valves 94. A second perforating gun 112*b* and a positioning tool 108 suspending by the cable 106 are placed within the lubricator 92, the lubricator 92 is reconnected to the master valves 94 at connection 93, the lubricator 92 is pressurized, and the second perforating gun 112*b* is lowered by cable 106 into the work string 98. Since the upper half (third section 10*c*) of a snaplock connector (also called the positioning tool 108) is connected to the lower portion of the perforating gun 112*b*, the perforating gun 112*b* and the upper half positioning tool 108 of the snaplock connector is lowered by the cable 106 into the work string 98. The first perforating gun 112*a* is still being held within the snaplock operator 102. The positioning tool (upper half, third section 10*c* of a snaplock connector) 108 on the bottom of the second perforating gun 112*b* is inserted into the lower half (first and second sections 10*a* and 10*b*) of the snaplock connector located at the top of the first perforating gun 112*a* now being held within the snaplock operator 102. However, the third section 10*c* (positioning tool 108) of the snaplock connector 110 is still in the unlocked position with respect to the first and second sections 10*a* and 10*b*.

Locking Second Perforating Gun to First Perforating Gun

In order to change from the unlocked position to the locked position (where the third section 10*c*, positioning tool 108 is locked to the first and second sections 10*a* and 10*b* of snaplock connector 110), the hydraulic pressure in the second port 102*c* of the snaplock operator of FIG. 20*e* is now reduced, and, as a result, the second piston 102*h* in FIG. 20*e* moves longitudinally from its position shown in FIG. 20*e* to its position shown in FIG. 20*a*. When this happens, the ring 102I will slide again within its slot 102*j*, from the position shown in FIG. 20*e*, to the position shown in FIG. 20*a*. When the ring 102I slides in its slot 102*j* to the position shown in FIG. 20*a*, the rack 102*k* is released from its contact position against the pinion teeth 10*b*3 on the outer periphery of the second section 10*b* of the snaplock connector 110 in FIG. 20*e*. When the rack 102*k* is released from the aforesaid contact position, the first and second section 10*a* and 10*b* is locked to the third section 10*c* of the snaplock connector 110.

Locating Second Perforating Gun in Snaplock Operator

Now, the hydraulic pressure in the first port 102*b* of the snaplock operator 102 can be reduced, which will retract the slips 102*g* from the extended position shown in FIG. 20*e* to the retracted position shown in FIG. 20*a*. With the slips 102*g* retracted, the first perforating gun 112*a* can be lowered, by winch 90, downhole, and the second perforating gun 112*b* can be disposed within the snaplock operator 102. The second perforating gun 112*b* has a lower half (first and second sections 10*a* and 10*b*) of a snaplock connector connected to its top part. When the second perforating gun 112*b* is disposed within the snaplock operator 102, the hydraulic pressure in the first port 102*b* is increased, which will extend the slips 102*g* (in FIG. 20*a*). When the slips 102*g* extend outwardly, they extend into the lock groove 10*a*3 of the first section 10*a* of the snaplock connector shown in FIG. 2 (and into the lock groove 10*a*3 of the snaplock connector 110 shown in FIG. 20*a*) resulting in the extended slips 102*g* being locked in the lock groove 10*a*3 of the first and second sections 10*a* and 10*b* (of the lower half) of the snaplock connector which is situated between the top of the second perforating gun 112*b* and the positioning tool 108.

The above steps, starting with unlocking the positioning tool, are repeated until the desired perforating gun string length, consisting of a plurality of perforating guns (or a plurality of other wellbore apparatus) interleaved with a corresponding plurality of snaplock connectors, are disposed below the snaplock operator 102 within the workstring 98 in the wellbore of FIG. 19, the snaplock operator firmly holding therein the lower half (first and second sections 10*a* and 10*b*) of a snaplock connector, which lower half is connected to the top part of the top-most perforating gun.

As a result, any desired length of perforating gun, or any desired length of wellbore apparatus, may be connected together prior to lowering such wellbore apparatus downhole, and this operation may be performed during one trip into the wellbore thereby saving time and money.

In the above discussion, the snaplock connectors 10 were disclosed to be interconnected between pairs of perforating guns, adapted to be disposed in a wellbore, for the ultimate purpose of creating any desired length of perforating gun to be disposed downhole. It is evident that other types of wellbore apparatus could be used in lieu of the perforating gun. For example, the snaplock connector 10 could be interleaved between a plurality of pairs of packers or setting tools or other wellbore apparatus.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. An apparatus for use in wellbore operations in a cased well, the apparatus comprising a snaplock operator defining an interior passage configured to pass downhole tools therethrough, the snaplock operator comprising an annular housing defining first and second hydraulic ports;

first and second pistons contained within the housing and adapted to move along the axis of the wellbore, the first and second pistons in hydraulic communication with the first and second housing ports, respectively;

a pivotable pawl arranged to be displaced into the interior passage of the snaplock operator to engage and retain a first portion of a downhole tool disposed within the snaplock operator as the first piston is moved by pressure applied at the first housing port; and a sliding element disposed within the housing and adapted to be moved into the interior passage of the snaplock operator to engage and rotate a second portion of the downhole tool while the first portion of the downhole tool is retained by the pivotable pawl, as the second piston is moved by pressure applied at the second housing port.

2. The apparatus of claim 1 further comprising a lubricator adapted to be mounted at the top of the wellbore, the lubricator including an internal, pressurized winch for lowering tools into the snaplock operator.

3. The apparatus of claim 1 wherein the snaplock operator is configured to be placed within the wellbore.

4. The apparatus of claim 1 wherein the sliding element has teeth adapted to engage mating teeth on the second portion of the downhole tool.

5. The apparatus of claim 1 comprising two said sliding elements adapted to simultaneously engage opposite sides of the second portion of the downhole tool.

6. The apparatus of claim 1 comprising four said pawls arranged about the internal periphery of the housing, each pawl adapted to rotate about a different axis.

7. The apparatus of claim 1 wherein the housing defines an internal slot extending at an angle with respect to the longitudinal axis of the snaplock operator interior passage, the second piston comprising an annular member with an extending tab arranged to slide along the slot as the piston is displaced, such that the second piston is rotated about its axis as it is displaced.

8. The apparatus of claim 2 further comprising a work string valve adapted to be mounted between the snaplock operator and the lubricator and arranged to close to block hydraulic communication between the lubricator and snaplock operator.

9. An apparatus for use in wellbore operations in a cased well, the apparatus comprising a hollow work string having upper and lower ends, the upper end adapted to be attached to a well head with the lower end of the work string disposed within the cased well below the well head; and a tool string connector operator attached to the lower end of the work string, the work string and connector operator together defining an interior passage for passing downhole tools therethrough, the connector operator having gripping means for engaging and retaining against rotation a first section of a tool string disposed within the connector operator; and rotating means for engaging and rotating a second section of the tool string with respect to the first section to decouple the first and second sections of the tool string.

10. The apparatus of claim 9 wherein the work string further comprises a valve disposed above the connector operator and adapted to be controllably closed to block hydraulic communication along the interior passage of the work string.

11. The apparatus of claim 10 wherein the work string valve is disposed below the well head, within the cased well.

12. The apparatus of claim 9 wherein the gripping means comprises a pivotable pawl arranged to be controllably displaced into the interior passage of the connector operator to engage and retain the first section of the tool string against rotation.

13. The apparatus of claim 9 wherein the rotating means comprises a sliding element adapted to be controllably moved into the interior passage of the connector operator to engage and rotate the second section of the tool string while the first section of the tool string is retained by the gripping means.

14. A method of making a tool string connection in a cased well under pressure using a snaplock operator defining an interior passage configured to pass downhole tools therethrough, the snaplock operator comprising a housing defining first and second hydraulic ports and the interior passage; and first and second pistons contained within the housing and adapted to move along the axis of the wellbore by pressure applied at the first and second housing ports, respectively;

the first piston arranged to be moved to retain a first portion of a downhole tool disposed within the snaplock operator, the second piston arranged to be moved to rotate a second portion of the downhole tool while the first portion of the downhole tool is so retained; the method comprising the steps of lowering a first tool string element into the snaplock operator on a positioning tool, the first tool string element having first and second members;

applying pressure to the first housing port to move the first piston to retain the first member of the first tool string element;

applying pressure to the second housing port to move the second piston to rotate the second member of the first tool string element to release the positioning tool and enable the first element to receive a second element;

removing the positioning tool;

lowering a second tool string element into the first element;

removing pressure from the second housing port to connect the first and second tool string elements; and removing pressure from the first housing port to release the first tool string element.

15. The method of claim 14 wherein the step of lowering the second tool string element comprises closing a work string valve above the snaplock operator to block well pressure;

placing the second tool string element within a lubricator having an internal winch adapted to be pressurized with the lubricator;

attaching the lubricator to the cased well above the work string valve;

pressurizing the lubricator to well pressure;

opening the work string valve; and lowering the second tool string element by the winch.

16. A method of decoupling adjacent sections of a tool string in a cased well having a well head under pressure, the method comprising raising a tool string into a hollow work string attached to the well head and extending down into the cased well, the work string having a tool string connector operator attached to its lower end, the work string and connector operator together defining an interior passage for passing downhole tools therethrough;

gripping a first section of the tool string with the connector operator; and while the first section of the tool string is retained against rotation by the connector operator, rotating a second section of the tool string with respect to the first section of the tool string to decouple the first and section tool string sections.

17. A method of operating a tool string connector disposed below a well head within a cased well under pressure, the method comprising attaching an upper end of a work string to the well head, with the work string extending through the well head to a lower end disposed below the well head, the work string having a tool string connector operator attached to its lower end, the work string and connector operator together defining an interior passage for passing downhole tools therethrough;

lowering a first section of a tool string downhole through the interior passage of the work string, and retaining the first section of the tool string with the connector operator;

lowering a second section of the tool string downhole through the interior passage of the work string to engage the first section retained by the connector operator;

actuating the connector operator to rotate the second section of the tool string with respect to the first section of the tool string to couple the first and second sections of the tool string; and releasing the first tool string section from the connector operator.

18. The method of claim 17 further comprising, after lowering the coupled tool string into the well to perform a downhole function, raising the coupled tool string into the connector operator;

gripping the first section of the tool string with the connector operator; and while the first section of the tool string is retained against rotation by the connector operator, rotating the second section of the tool string with respect to the first section of the tool string to decouple the first and section tool string sections;

raising the second section of the tool string from the well;

releasing the first section of the tool string from the connector operator; and raising the first section of the tool string from the well.

* * * * *